United States Patent [19]

Bull

[11] Patent Number: 4,934,690

[45] **Date of Patent: * Jun. 19, 1990**

[54] SHOCK-FREE AEROBIC AND ANAEROBIC EXERCISING MACHINE FOR USE IN THE STANDING POSITION

[76] Inventor: John W. Bull, 2502 Wedgewood Ct., Olympia, Wash. 98501

[ * ] Notice: The portion of the term of this patent subsequent to May 16, 2006 has been disclaimed.

[21] Appl. No.: 351,846

[22] Filed: May 12, 1989

Related U.S. Application Data

[63] Continuation-in-part of Ser. No. 181,302, Apr. 13, 1988, Pat. No. 4,830,362.

[51] Int. Cl.[5] ..... A63B 23/04

[52] U.S. Cl. ..... 272/70; 272/130

[58] Field of Search ..... 272/70, 71, 72, 73, 272/96, 97, 69, 130

[56] References Cited

U.S. PATENT DOCUMENTS

| | | | |
|---|---|---|---|
| 326,247 | 9/1885 | Root . | |
| 1,176,365 | 3/1916 | Hartnett . | |
| 1,521,487 | 12/1924 | Turner . | |
| 2,079,594 | 5/1937 | Clem | 128/25 |
| 2,253,996 | 8/1941 | Bechman | 272/57 |
| 2,969,060 | 1/1961 | Swanda et al. | 128/25 |
| 3,381,958 | 5/1968 | Gulland | 272/69 |
| 3,495,824 | 2/1970 | Cuinier | 272/80 |
| 3,511,500 | 5/1970 | Dunn | 272/79 |
| 3,529,474 | 9/1970 | Olson et al. | 73/379 |
| 3,566,861 | 3/1971 | Weiss | 272/96 |
| 3,582,069 | 6/1971 | Flick et al. | 272/79 |
| 3,587,319 | 6/1971 | Andrews | 73/379 R |
| 3,598,404 | 8/1971 | Bowman | 272/570 |
| 3,628,791 | 12/1971 | Garcia | 272/83 R |
| 3,747,924 | 7/1973 | Champoux | 272/79 R |
| 3,758,112 | 9/1973 | Crum et al. | 272/79 C |
| 3,759,511 | 9/1973 | Zinkin et al. | 272/58 |
| 3,792,860 | 2/1974 | Selnes | 272/70 |
| 3,814,420 | 6/1974 | Encke | 272/83 R |
| 3,970,302 | 7/1976 | McFee | 272/130 |
| 3,976,058 | 8/1976 | Tidwell | 128/25 R |
| 4,188,030 | 2/1980 | Hooper | 272/73 |
| 4,336,934 | 6/1982 | Hanagan | 272/72 |
| 4,550,908 | 11/1985 | Dixon | 272/130 |
| 4,563,001 | 1/1986 | Terauds | 272/72 |
| 4,600,187 | 7/1986 | Schenker | 272/70 |
| 4,618,139 | 10/1986 | Haaheim | 272/70 |
| 4,632,385 | 12/1986 | Geraci | 272/70 |
| 4,650,181 | 3/1987 | Yang | 272/72 |
| 4,681,316 | 7/1987 | De Cloux | 272/130 |
| 4,684,126 | 8/1987 | Dalebout et al. | 272/72 |
| 4,708,338 | 11/1987 | Potts | 272/70 |
| 4,733,858 | 3/1988 | Lan | 272/70 |
| 4,838,543 | 6/1989 | Armstrong et al. | 272/70 |

FOREIGN PATENT DOCUMENTS

| | | | |
|---|---|---|---|
| 2243794 | 3/1974 | Fed. Rep. of Germany | 272/70 |
| 2919494 | 11/1980 | Fed. Rep. of Germany | 272/70 |
| 593703 | 1/1978 | U.S.S.R. | 72/73 |

*Primary Examiner*—Stephen R. Crow

*Attorney, Agent, or Firm*—F. Eugene Logan

[57] ABSTRACT

A shock-free exercising machine, which can be used by the young and elderly, the small and large structured person, and the inexperienced and experienced exerciser for both aerobic and anaerobic exercise, that provides a rhythmic fluid motion to the body of the user and particularly to the legs, pelvis and spine which is completely free of shock and impact stress on the joints, bones and muscles in which, at all times, the user remains in an upright standing position. In one embodiment the exercise simulates climbing motion of the user's legs with synchronized push-pull motion of the user's arms. On one embodiment the exercising machine comprises a base member; a vertical frame member fixedly attached there, right and left lower levers pivotally mounted on the lower part of the vertical member, the free ends the levers for standing on; right and left upper levers pivotally mounted on the upper part of the vertical member; right and left tie rods pivotally mounted at the upper distal ends thereof to the right and left upper levers, respectively, and pivotally mounted at the lower distal ends thereof to the right and left lower levers, respectively; rocker arm assembly for synchronizing the movement of the lower levers so that when one lower lever moves downwardly the other one moves upwardly; and shock-free resistance system for resisting the movement of at least one of the levers.

49 Claims, 15 Drawing Sheets

SHOCK-FREE AEROBIC AND ANAEROBIC EXERCISING MACHINE FOR USE IN THE STANDING POSITION

CROSS-REFERENCE TO RELATED APPLICATIONS

This application is a continuation-in-part application of Ser. No. 181,302, filed Apr. 13, 1988, now U.S. Pat. No. 4,830,362. This application is related to pending U.S. Ser. No. 183,184 filed Apr. 19, 1988, Ser. No. 109,103, filed Oct. 21, 1987, which is a continuation-in-part application of Ser. No. 012,119.

BACKGROUND OF THE INVENTION

1. Field of the Invention

The present invention relates to aerobic and anaerobic exercise equipment. More particularly, the invention concerns conditioning apparatus for shock-free exercising the user's legs and, in one embodiment, the full body, that is the upper and lower body simultaneously.

2. Discussion of the Invention

Walking and jogging have been traditional forms of aerobic exercise and weight lifting a traditional form of anaerobic exercise. The traditional form of weight lifting which requires barbells or complex machines with chains and weights, are not usually used for aerobic conditioning. In recent years, aerobic conditioning has become increasingly popular as evidenced by membership clubs providing supervised aerobic classes.

As jogging has become more popular the medical profession has noticed an increase of impact related to injuries to the back, legs, feet and joints. To a lesser extent, regular walking has also contributed to these types of injuries. Those active in sports medicine generally agree that long-term jogging and walking, particularly on hard surfaces without proper equipment can result in serious debilitating injuries.

In addition to jogging and walking, which require relatively little expense for equipment, bicycling, tennis, handball, squash and similar sports are also a popular form of exercise particularly for the legs and lower body. Unfortunately, all of these sports can cause serious bodily injury if one is not careful. Furthermore, many of these sports require expensive special facilities and, if practiced in indoor facilities to avoid the uncertainties of the weather, become even more expensive.

Swimming is, of course, a well known and a popular form of full-body, shock-free exercise and is generally considered safer and far more beneficial than the above mentioned sports. Unfortunately, costly, special facilities are required and, in many parts of the country, private swimming pools are impractical due to weather considerations.

In an attempt to overcome the drawbacks of jogging, several manufacturers have produced elaborate types of treadmill-type apparatus. Such apparatus basically exercise only the lower body and are typically quite expensive and often cumbersome, greasy and noisy to use. Maintenance costs for such equipment can be high and considerable space is often required for the equipment. Further, treadmill apparatus can be dangerous to use and injurious falls can occur with their use.

An example of a treadmill-like device with moving steps on a ramp is disclosed in U.S. Pat. No. 3,970,302, which also discloses an alternate device with pivotally mounted foot support members synchronized by a cable and pulley arrangement. Unfortunately, the exercising machines disclosed depend in part on chains, which are usually noisy and greasy, or cables or ropes which tend to become frayed and break. Frayed wire cables are particularly hazardous because of the potential to cut the user's hands, arms and legs. Cables and ropes also have the tendency to break thereby causing a sudden and often dangerous snap reaction to the user's body and limbs. Mechanisms using cables, ropes and chains generally have a certain amount of play when the mechanism is reversed thereby causing a jerky, bumpy or resistance-free movement especially at the beginning of the cycle when the direction of movement has been reversed. Since cables and ropes tend to stretch, mechanisms using them have an of undesirable amount of variation from one usage to the next. Furthermore, since cable and ropes do not support compressive loads, they can be dislodged from pulleys or damaged when the ropes or cables of such mechanisms are accidentally subjected to compressive loads. Examples of such machines are shown in U.S. Pat. Nos. 3,792,860 and 4,563,001.

The patented device of 4,563,001 uses a slot containing a cam follower to control movement of the levers. Unfortunately as the direction of motion of the levers is reversed at the end of each half cycle, play occurs between the slot and the cam follower. This play then becomes amplified at the ends of the foot and hand levers at the end of each half cycle as the direction of the motion is reversed.

One device which avoided the disadvantages of ropes, cables, and chains is disclosed in U.S. Pat. No. 4,600,187, which used a rocker plate which contained a pair of openings through which a corresponding pair of steps arms are loosely held or fitted. Because the steps arms must slide freely in the openings through which they pass, play is experienced at the end of each half cycle as the direction of motion is reversed. The sliding of the step arms in the openings tends to abrade or damage the step arms and openings thereby increasing the amount of play in the mechanism. Such abrasion together with the bending forces on the step arms at the point of slidable support at the opening tends to bend the step arms. When the step arms become bent, it can be appreciated that a major repair of the device is required. While these devices area useful, it is, nevertheless, well recognized that sports professionals highly favor exercise devices which provide a smooth and constant force to the user's body which is free of play, jerks or binding or sticking resistance in the devices moving parts.

Therefore, what is desired is an exercising machine which, will exercise the legs and lower body and without bumpy, jerky, or slack movement at the beginning of a cycle when the direction of motion of the mechanism is reversed. It would be especially desirable if the mechanism would like swimming, exercise the entire body. In any exercise machine it is also desirable that the device not have the disadvantages of the above mentioned sports such as high cost, weather dependency, and inducement of shock and unnecessary stress to the body. So that such an exercising machine can be enjoyed by many, it should be relatively inexpensive. So that it can be used by the apartment dweller, it should be a quiet and clean machine when used and not require weights or chains of components which require substantial amount of grease for lubrication or wire cables or ropes which fray and break. Furthermore, it would be highly desirable if the exercising machine could be used both for aerobic or cardiovascular exercise as well as anaerobic or muscle building exercise to the extent desired by the user.

The apparatus of the present invention offers all of above mentioned advantages, requires a relatively small space so that it can be used and stored in the user's living room, and it is both relatively inexpensive to manufacture and maintain. In fact, the exercising machine of this invention is largely maintenance free.

SUMMARY OF THE INVENTION

It is an object of this invention to provide an exercising machine which can be used for both aerobic and anaerobic exercising.

It is another object of the invention to provide an exercising machine which is safe to use by one inexperienced in aerobic or anaerobic exercises.

Another object of the invention is to provide an exercising machine in which the exercise is completed in a smooth, shock-free manner with minimum impact stress exerted on the muscles and joints of the user's body.

It is a further object of this invention to provide an exercising machine in which at all times the user remains in an upright standing position.

It is an object of one embodiment of this invention to provide an exercising machine for the full body or entire exercise of the human body.

Yet another object of this invention is to provide an exercising machine which combines a push and pull motion of the arms in a front to back to front arm movement with simultaneous and synchronized climbing motion of the legs.

Still another object of this invention is to provide an exercising machine in which at the end of a cycle the limbs on one side of the user's body are straight with the arm extended straightly in front and the leg extended straightly down while the user's limbs on the user's other side are bent at least about a right angle at the elbow and knee.

A further object of this invention is to provide an exercising machine in which the user's limbs on one side of the user's body are straightening and approaching full limb extension while the user's limbs on the user's other side are bending and approaching a bend of at least about a right angle, relative to fully extended or straight position, at the elbow and knee.

Still another object of this invention is to provide an exercising machine which when used over several cycles will induce a natural rhythmic motion to the human body by causing an oscillatory motion to the spinal column, neck and head of the user while simultaneously flexing the user's arms and legs from fully extended and straightened position to a bent orientation of at least about a right angle and while simultaneously exercising neck, spine, pelvic and ankle muscles.

Yet another object of one embodiment of this invention is to provide an exercising machine which can be used by the young or elderly, by the small or large statured person, and by the frail or strong.

Still another object of one embodiment of this invention is to provide an exercising machine in which the resistance of the machine to the exertive forces of the user can be adjusted quickly and even without dismounting from the machine by the mere adjustment of a single small needle valve or similar means.

Still a further object of this invention is to provide an exercising machine which is whisper quiet and can be used in an apartment while watching television or listening to music to lessen the boredom usually associated with exercising, without requiring the volume of such audio appliances to be increased to overcome the noise produced by the machine.

Yet another object of this invention is to produce a exercising machine which is completely free of chains and weights and such noises are typically produced during the use of conventional exercising machines containing chains and weights.

A further object of this invention is to produce a relatively light weight, exercising machine which does not require grease and is clean and attractive enough that it can remain in the bedroom or living room of the user and not be relegated to the user's garage, basement or attic because of its unattractive appearance or greasy condition.

Another object of this invention is to provide a exercising machine which is relatively inexpensive but exceptionally durable and maintenance free. These and other objectives and advantages will be made apparent from the following description of this invention.

It is also desirable to provide a full body exercising machine in which the synchronized movement of the user's arms with the user's legs can be varied thereby providing two types of full body exercise with one machine.

Accordingly there is provided by the principles of this invention an exercise machine for synchronized exercise of an user's legs while remaining in an upright standing position, the exercise machine comprising:

a base structure operable for maintaining the exercise machine in an upright standing position;

an upright frame member extending upwardly from the base structure;

right and left lower lever arms having first ends pivotally mounted on a lower portion of the upright frame member about a first, lower pivot axis, the opposite, free ends of the right and left lower lever arms being operable for standing on by the user's right and left feet, respectively;

synchronizing means for synchronizing the movement of the lower lever arms, the synchronizing means comprising a rocker arm and right and left connection means, the rocker arm having right and left ends and pivotally mounted at its center to the upright frame member thereby enabling it to rotate in a traverse plane which is approximately vertical, the right connection means having one end pivotally connected to the right lower lever and an opposite end pivotally connected to the right end of the rocker arm, the left connection means having one end pivotally connected to the left lower lever and an opposite end pivotally connected to the left end of the rocker arm, the synchronizing means being operable when one of the lower lever arms is moving downwardly to cause the other one of the lower lever arms to move upwardly, and when the free end of one of the lower lever arms is at its lowest elevation, the free end of the other of the lower lever arms is at its highest elevation; and resistance means for resisting the movement of at least one of lever arms.

In one embodiment the synchronizing means includes means for preventing play in the lower lever arms when the direction of the lower lever arms is reversed.

In another embodiment the right and left connection means are pivotally connected to the rocker and the lower levers by ball-and-socket joints, which are referred to herein as simply ball joints. The terms ball joints and ball-and-socket joints is meant to joints in which the ball is not a complete sphere but also joints in which the spherical surface is sufficient to permit the joint to swivel as needed without introducing binding, bending, strain or other detrimental forces, play or slack in the joint.

In still another embodiment when the free end of one of the lower lever arms is at its lowest elevation the distance between the free ends of the lower lever arms define a maximum step height, and the exercise machine further comprises means for adjusting the maximum step height of the lower lever arms. In yet another embodiment the connection means includes means for adjusting the maximum step height.

In one embodiment the exercise machine further comprises a hand grip fastened to the upright frame member. In one embodiment the exercise machine further comprises right and left upper arms each having a hand grip, and the upper arms are fastened to the upright frame member. In a further embodiment the upper arms are pivotally connected to the upright frame member.

In one embodiment the right and left upper arms include means for synchronizing the movement of the right upper arm to the left upper arm.

In another embodiment the exercise machine further comprises resistance means for resisting the movement of the upper arms and in a still further embodiment the resistance means is adjustable over a range of resistances.

In one embodiment the upright frame member includes a post having its lower end fixedly attached to the base structure.

There is also provided by the principles of this invention an exercise machine for synchronized exercising of an user's legs and arms while remaining in an upright standing position, the exercise machine comprising:

a base structure operable for maintaining the exercise machine in an upright standing position;

an upright frame member extending upwardly from the base structure;

right and left lower lever arms having first ends pivotally mounted on a lower portion of the upright frame member about a first, lower pivot axis, the opposite, free ends of the right and left lower lever arms being operable for standing on by the user's right and left feet, respectively;

means for synchronizing the movement of the lower lever arms, said synchronizing means being operable when one of the lower lever arms is moving downwardly to cause the other one of the lower lever arms to move upwardly, and when the free end of one of the lower lever arms is at its lowest elevation, the free end of the other of the lower lever arms is at its highest elevation;

right and left upper lever assemblies each having (i) an upper lever arm pivotally mounted on the upright frame member about a second, upper pivot axis located at an elevation above the elevation of the lower pivot axis; and (ii) a hand grip connected to the upper lever arm and intended for hand grasping, the upper lever assemblies being operable for rotating the hand grips in a principally forward to rearward to forward motion; and resistance means for resisting the movement of at least one of the lever arms. In a further embodiment the exercise machine further comprises:

means for synchronizing the movement of one of the upper lever arms to one of the lower lever arms; and means for synchronizing the movement of the other one of the upper lever arms to the other one of the lower lever arms.

In one embodiment the exercise machine further comprises means for preventing play in the upper lever arms when the direction of the upper lever arms is reversed, and in a preferred embodiment the means for synchronizing the movement of the upper lever arms to the lower lever arms includes means for preventing play in the upper lever arms when the direction of the upper lever arms is reversed. In one embodiment the means for preventing play comprises tie rods having ball and socket pivotal connection to the upper and lower lever arms.

In one embodiment the second, upper pivot axis is located at an elevation substantially above the elevation of the first, lower pivot axis.

In another embodiment wherein the distance between the first, traverse lower pivot axis and the free end of the lower lever defines a lower-lever-longitudinal length, and wherein the distance between the second, traverse upper pivot axis and the first, traverse lower pivot axis defines a pivot-to-pivot separation, and the ratio defined by $$\frac{\text{the pivot-to-pivot separation}}{\text{the lower-lever-longitudinal length}}$$

is at least about $\frac{1}{2}$.

In a further embodiment the ratio $$\frac{\text{the pivot-to-pivot separation}}{\text{the lower-lever-longitudinal length}}$$

is at least about $\frac{2}{3}$ preferably at least about $\frac{3}{4}$, and especially preferably at least about $\frac{7}{8}$.

In another embodiment the exercise machine also comprises: linkage means interconnecting the right and left lower level arms with corresponding right and left upper lever assemblies, whereby rotation of a lower level arm on first side of the exercise machine in one direction about the lower pivot axis causes rotation of the upper lever arm on one side of the machine in an opposite direction about the upper pivot axis, and whereby, when the free end of either of the lower lever arms is in its lowest elevation, the free end of the handlebar on one side of the exercise machine is in its farthest position away from the lower lever arm free end and whereby, when the free end of either of the lower lever arms is at its highest elevation, the free end of the handlebar on one side of the machine is in its nearest position toward the lower lever arm free end.

In a further embodiment the linkage means comprises:

right and left tie rods;

first means for pivotally connecting the upper ends of the tie rods to the right and left upper lever assemblies, respectively; and, second means for pivotally connecting the lower ends of the right and left tie rods to the right and left lower lever arms, respectively.

In yet another embodiment the resistance means is interconnected to at least one of the lower lever arms or upper lever assemblies.

There is also provided by the principles of this invention an exercising machine having a cycle for the full body, shock-free, exercise of the human body in which at all times the user remains in an upright standing position, such full body exercise simulating climbing motion of the user's legs with synchronized push-pull motion of the user's arms.

whereby at the start of the cycle with the user's body weight shifted to the right side of the machine, the user's right limbs are fully extended with the user's right arm in front of the user and at about a right angle to the user's right leg, and the user's left limbs are bent with the user's left leg being bent at the knee at least about a right angle and the user's left arm being bent at the elbow at least about a right angle, whereby shifting of the user's body weight to the left side of the machine commences bending of the user's right limbs and straightening of the user's left limbs such that at mid cycle of the machine the user's left limbs are fully extended with the user's left arm in front of the user and at about a right angle to the user's left leg, and the user's right limbs are bent with the user's right leg being bent at the knee at least about a right angle and the user's right arm being bent at the elbow at least about a right angle, whereby at mid-cycle of the machine, shifting of the user's body weight back to the right side of the machine commences bending of the user's left limbs and straightening of the user's right limbs such that at the end of the cycle of the machine the user's right limbs are fully extended with the user's right arm in front of the user and about a right angle to the user's right leg, and the user's left limbs are bent with the user's left leg being bent at the knee at least about a right angle and the user's left arm being bent at the elbow at least about a right angle.

The full body exercising machine of this invention comprises a base member operable for maintaining the machine in an upright standing position, and a vertical frame member fixedly attached to the base member proximate the rearward end thereof.

The machine further comprises right and left lower levers pivotally mounted on the lower part of the vertical frame member at a lower pivot point and horizontally and forward extending therefrom, the free ends of the right and left lower levers being operable for standing on by user's right and left feet, respectively, right and left upper levers means pivotally mounted on the upper part of the vertical frame member at an upper pivot point and horizontally and rearwardly extending therefrom, a portion of the right and left upper lever means serving as right and left hand grips, respectively, and right and left tie rods pivotally mounted at the upper distal ends thereof to the right and left upper lever means, respectively, and pivotally mounted at the lower distal ends thereof to the right and left lower levers, respectively, such that rotation of the lower lever on either side of the machine in one direction causes rotation of the upper lever means on the same side of the machine in an opposite direction, whereby when the free ends of either of the lower levers is at its lowest elevation, the hand grip of the upper lever means on the same side of the machine is at its farthest rearward position, and whereby when the free end of either of the lower levers is at its highest elevation, the hand grip of the upper lever means on the same side of the machine is at its farthest forward position.

The machine further comprises means for synchronizing the movement of the lower levers, the means being operable when one of the lower levers is moving downwardly to cause the other one of the lower levers to move upwardly, and when the free end of one of the lower levers is at its lowest elevation the free end of the other one of the lower levers is at its highest elevation. The distance between the free ends of the lower levers when one of the lower levers is at its lowest elevation defines a maximum step height, and the distance between the hand grips when one of the hand grips is at its farthest forward position defines a maximum hand spread. The lower levers being operable to effect a maximum step height large enough to cause one of the user's legs to be bent at the knee at least about a right angle when the other one of the user's legs is straight, and the upper lever means being operable to effect a maximum hand spread large enough to cause one of the user's arms to be bent at the elbow at least about a right angle when the other one of the user's arms is straight. The machine also comprises shock-free resistance means for resisting the movement of the right and left lower levers. Travel of the free end of one of the lower levers from its lowest elevation to its height elevation and thence back to its lowest elevation defines a full cycle. Accordingly, when a user stands on the free ends of the lower levers and tightly grips the hand grips, while causing the machine to complete the full cycle, the user experiences a full body, shock-free exercise simulating climbing motion of the user's legs with synchronized push-pull motion of the user's arms.

In one embodiment of this invention, the right and left upper lever means comprises right and left upper levers pivotally mounted on the upper part of the vertical frame member at an upper pivot point and horizontally and rearwardly extending therefrom; and right and left handlebars fixedly mounted on the right and left upper levers, respectively, the handlebars extending vertically from the upper levers, the free ends of the right and left handlebars being operable for being tightly gripped by an user's right and left hands, respectively, whereby when the free ends of either of the lower levers is at its lowest elevation, the free end of the handlebar on the same side of the machine is at its farthest rearward position, and whereby when the free end of either of the lower levers is at its highest elevation, the free end of the handlebar on the same side of the machine is at its farthest forward position.

In one embodiment of this invention, the maximum step height is at least about 25 centimeters and the maximum hand spread is at least about 50 centimeters.

In another embodiment, the synchronizing means is adjustable and operable for varying the maximum step height. In a further embodiment, the synchronizing means comprises a rocker arm and right and left linking rods, the rocker arm has right and left ends and is pivotally mounted at its center to the vertical frame member thereby enabling the rocker arm to rotate in a traverse plane which is approximately vertical, the right linking rod has one end pivotally mounted to the right lower lever and an opposite end pivotally mounted to the right end of the rocker arm, and the left linking rod has one end pivotally mounted to the left lower lever and an opposite end pivotally mounted to the left end of the rocker arm. In a still further embodiment, the linking rods have an effective length which can be adjusted to predetermined values thereby enabling the maximum step height to be adjusted to corresponding predetermined values corresponding to the height and stamina of the user.

In another embodiment of this invention, the resistance means for resisting the movement of the right and left lower levers, has one end of the resistance means pivotally mounted on the upper part of the vertical frame member and another end of the resistance means being pivotally mounted on one of the lower levers.

In yet another embodiment of this invention, the resistance means is adjustable and operable for varying the force required to move the lower levers.

In still another embodiment of this invention, the resistance means comprises hydraulic cylinder having a slidable piston therein connected to a piston rod, the piston dividing the hydraulic cylinder into an internal upper zone above the piston and an internal lower zone below the piston, and a conduit containing a flow restrictor, the conduit providing fluid communication between the upper and lower zones of the hydraulic cylinder, the external end of the piston rod being one end of resistance means and the external end of the hydraulic cylinder opposite the piston rod being an opposite end of the resistance means. In a further embodiment the piston rod extends through both ends of the cylinder thereby insuring that the volume displaced on one side of piston equals the volume increase on the other side of the piston. In yet another embodiment, the flow restrictor is adjustable and operable for varying the force required to move the lower levers. In a still further embodiment, the flow restrictor is a needle valve.

BRIEF DESCRIPTION OF THE DRAWINGS

FIG. 16 is a rear elevational view of the upper part of the embodiment shown in FIG. 15.

DESCRIPTION OF THE PREFERRED EMBODIMENT

Figure 1:
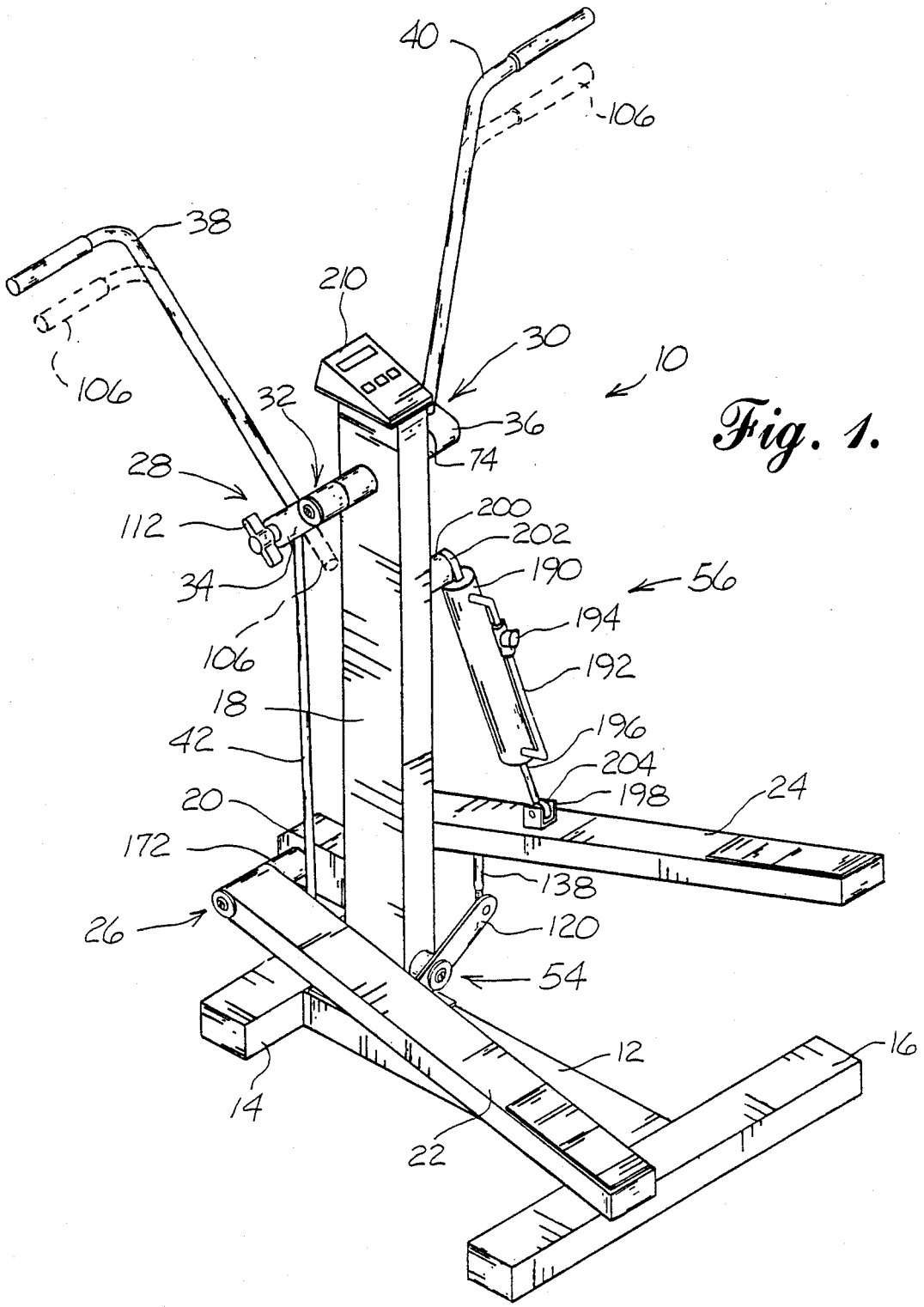
FIG. 1 is a top, front and right perspective view of the exercising machine of this invention.
Figure 2:
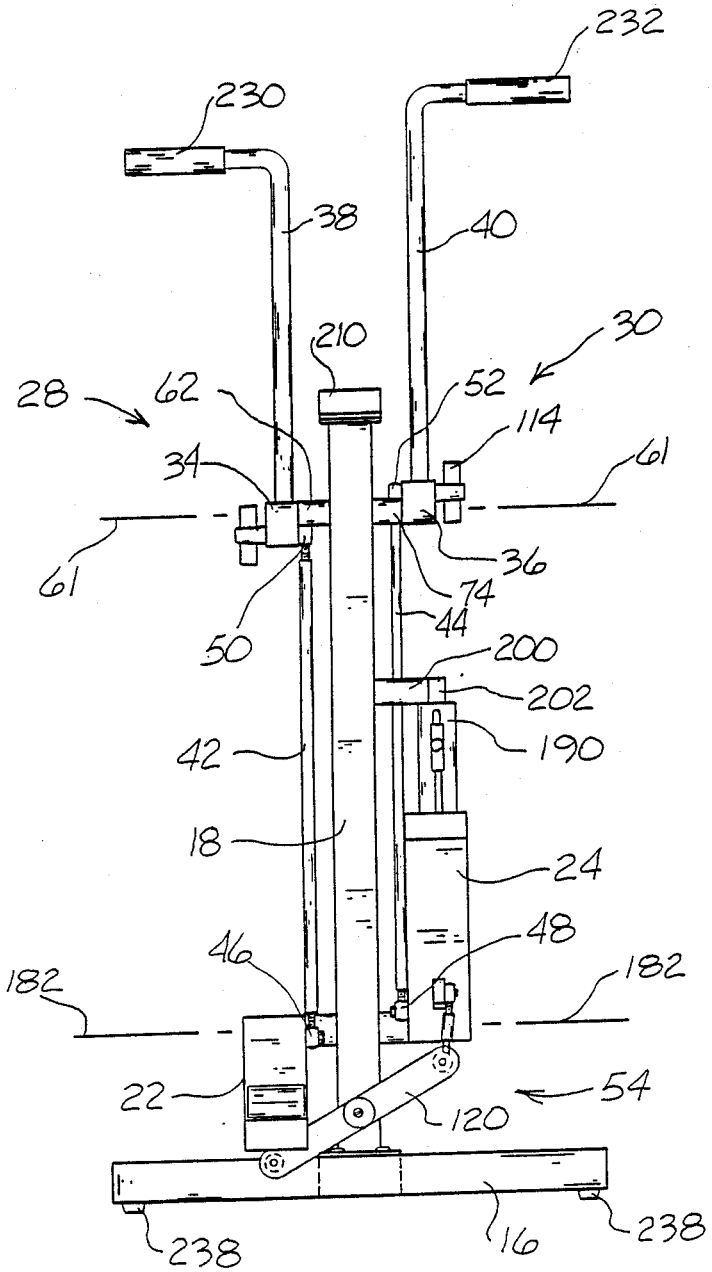
FIG. 2 is a front elevational view of the machine of FIG. 1.

An exercising machine of this invention is indicated generally by reference numeral 10 of FIG. 1. The machine comprises longitudinal base frame member 12 rigidly fastened to rear and front traverse base frame members 14 and 16, respectively, which provide lateral stabilization of the machine when it is in use. Members 12, 14 and 16 provide a base structure for the exercising machine. Referring to FIGS. 1 to 4, also rigidly fastened to member 12 is upstanding or upright frame member 18 to which is rigidly fastened to extension frame member 20. Machine 10 further comprises left and right lower levers 24 and 26, respectively, sometimes referred to as lower lever arms, pivotally mounted to frame member 20 by lower lever pivot means 26, and opposing left and right upper lever means 28 and 30, respectively, sometimes referred to as upper lever arms, pivotally mounted to frame member or post 18 by upper lever pivot means 32. Left upper lever means or left upper lever assembly 28 comprises left upper lever 34 and left handlebar 38. Similarly, right upper lever means or right upper lever assembly 30 comprises right upper lever 36 and right handlebar 40. The free ends of handlebars 38 and 40 are preferably bent outwardly at approximately a right angle to facilitate hand gripping by the user.

Synchronized movement of the left lower lever 22 and left upper means 28 is accomplished by left tie rod 42 which is pivotally mounted to lower and upper levers 22 and 34 by lower and upper tie rod ball joints 46 and 50, respectively, thereby providing linkage means interconnecting the left lower lever arm with left upper lever assembly. Similarly synchronized movement of right lower lever 24 and right upper means 30 is accomplished by right tie rod 44 which is pivotally mounted to lower and upper levers 24 and 36 by lower and upper tie rod ball joints 48 and 52, respectively, thereby providing linkage means interconnecting the right lower lever arm with right upper lever assembly.

Synchronized movement between right and left sides of machine 10 is accomplished by right to left side synchronization means 54. Use of machine 10 without reaction resistance would do little to improve the body tonal quality of the user. Accordingly the machine also comprises resistance means 56. Means 54 and 56 will be described in greater detail later.

Figure 3:
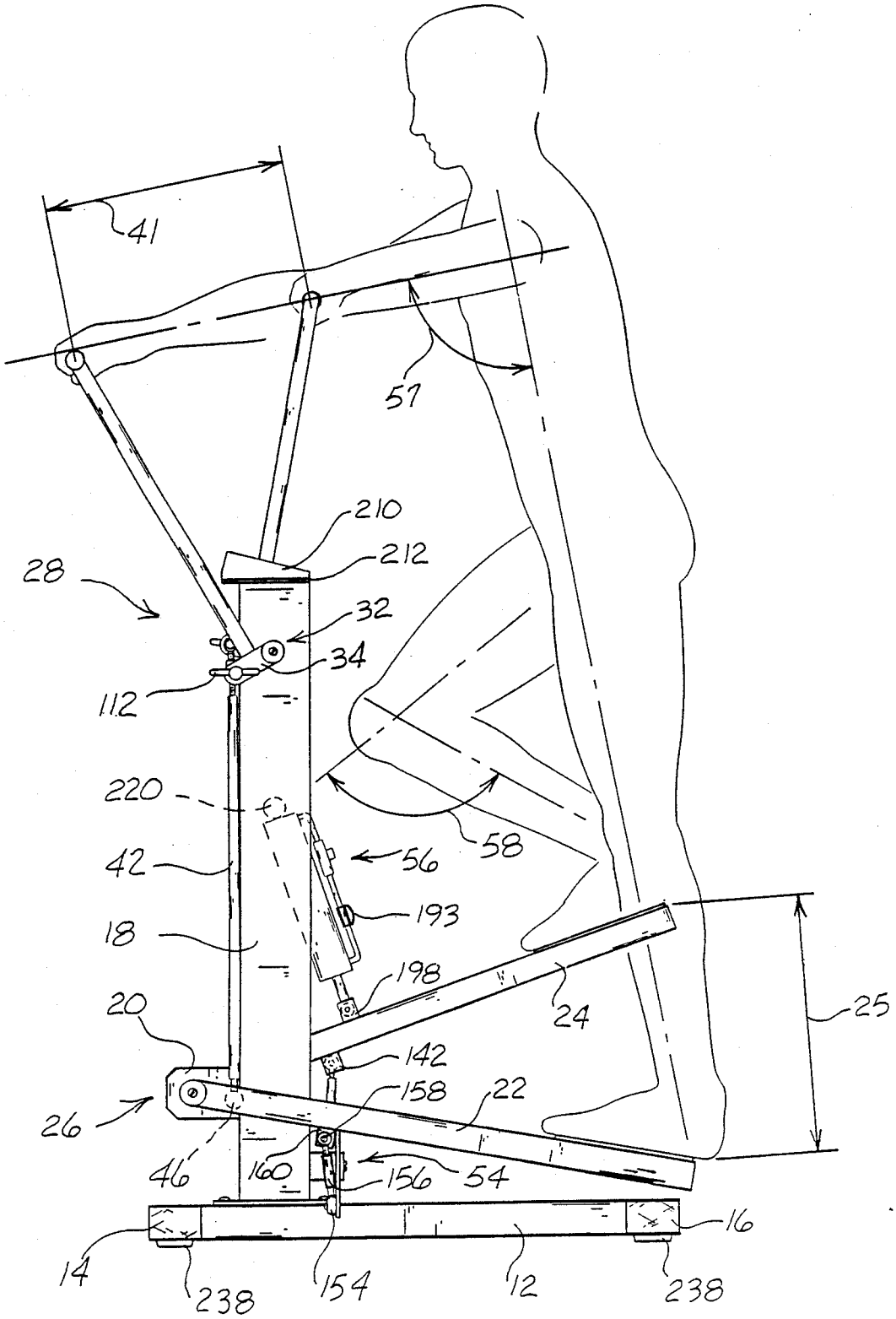
FIG. 3 is a left side elevational view of the machine of FIG. 1 showing a person using the machine.
Figure 4:
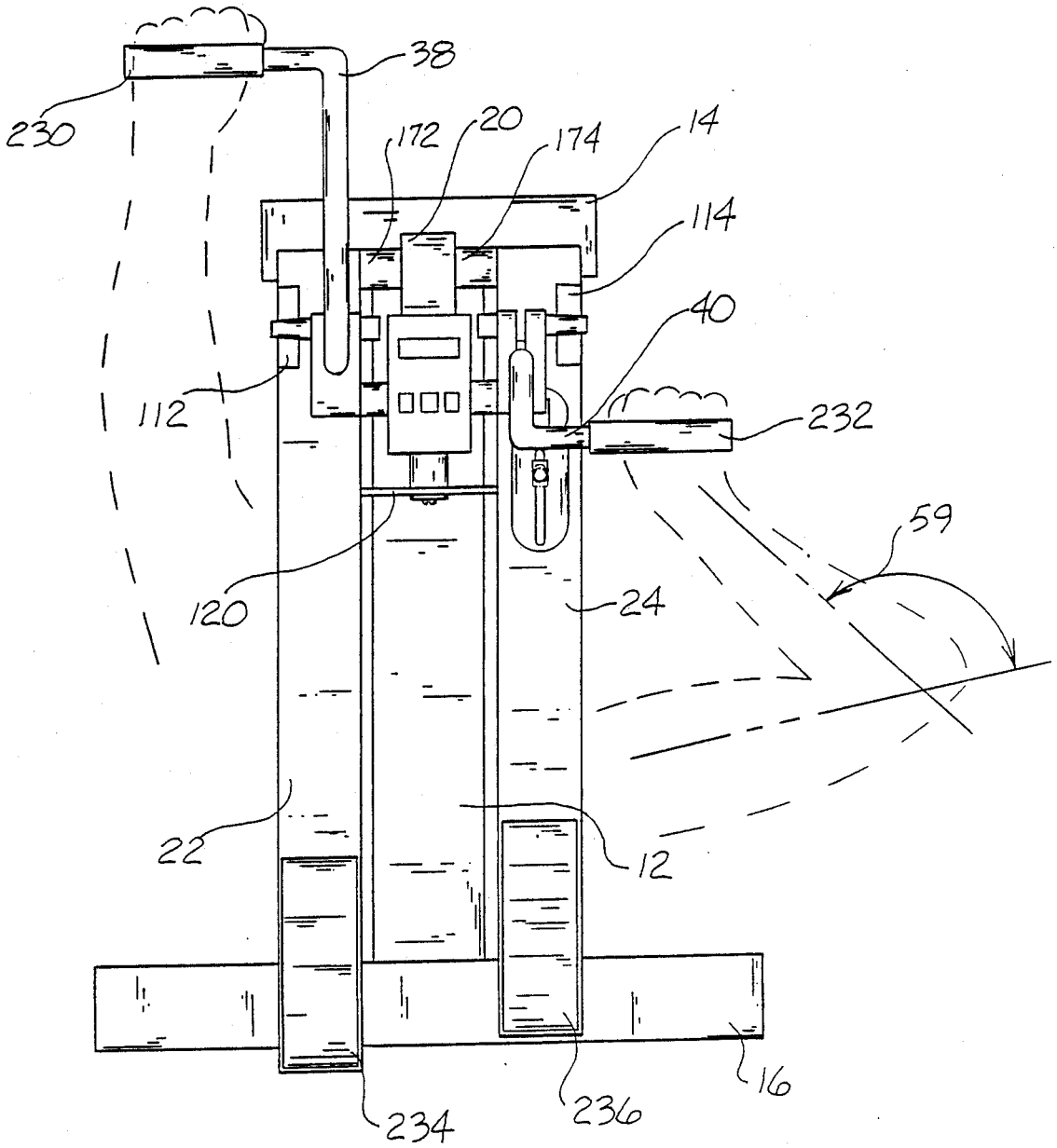
FIG. 4 is a top plan view of the machine of FIG. 1 showing the position of the user's arms when the user's legs are in the position shown in FIG. 3.

FIG. 3 shows the exercising machine with lower lever 22 in its lowest elevation which because of synchronization means 54 requires lower lever 24 to be in its highest elevation thereby defining a maximum step height denoted by distance element 25. Since tie rods 42 and 44 require the upper levers and handlebars 38 and 40 to rotate with the rotation of lower levers 22 and 24, when the maximum step height of the machine occurs there also occurs a maximum hand spread denoted by distance element 41. At the start of the cycle as shown in FIG. 3 in which the maximum step height and maximum hand spread occur, it can be seen that the left leg of the user is straight while the right leg is bent at the knee at least about a right angle as denoted by angle element 58, which is in fact about 114°. Further, while the left arm is straight or nearly straight, the right arm is bent at the elbow at least about a right angle as denoted by angle element 59 shown in FIG. 4. In fact, angle 59 is about 120°. It can also be seen that the user's left arm is extended straightly in front of the user and forms about a right angle to the user's left leg which is extended straightly downwardly as shown by angle element 57. It can be understood that the side to side reverse conditions exist at midcycle when lever 24 is at its lowest elevation and lever 22 at its highest elevation. Thus over the course of one cycle both the upper body and lower body of the user of the exercise machine of this invention are exercised by the alternate bending of the user's limbs first on one side of the body and then on the other side of the body while simultaneous causing ankle, leg, hip, back and shoulder exercise. In fact, even gentle exercise of the neck occurs naturally induced by the shifting of the user's body weight from left to right to left over the cycle. With many cycles a rhythmic motion is developed by the user operable for providing a full body exercise.

Figure 5:
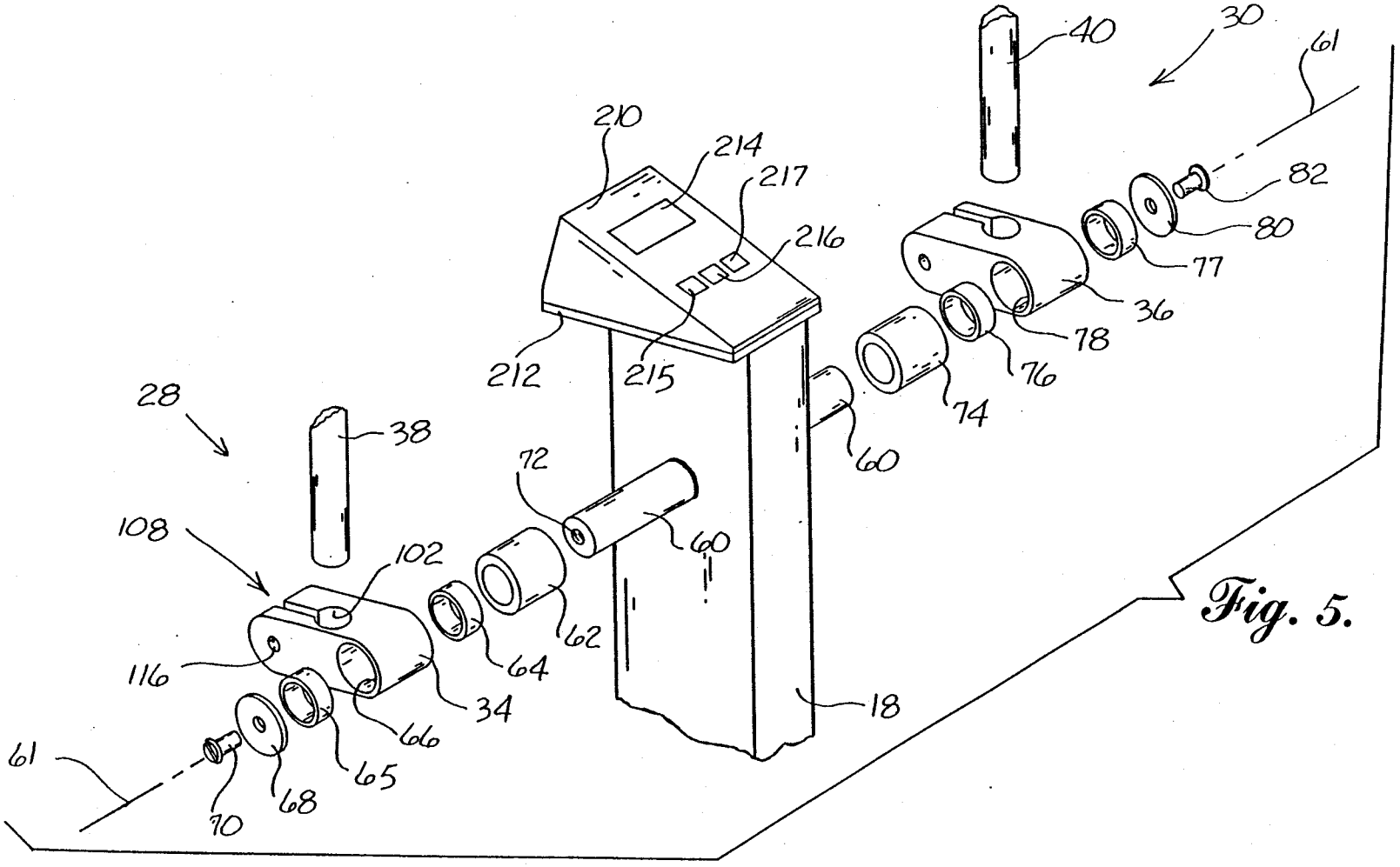
FIG. 5 is an explosive perspective view of the upper lever pivot means showing the several parts in axially alignment.

The assembly of left and right upper lever means 28 and 30 to pivot means 32 is shown in greater detail by the explosive view of FIG. 5. Shaft 60 is rigidly fastened to frame member 18 as, for example, by welding. Shaft 60 preferably extends through member 18 and is welded on each side thereof. With regard to the left side of the machine, spacer bushing 62 is slid over shaft 60 until bushing 62 abuts member 18. Sintered bronze bushings 64 and 65 are press fitted into bore 66 of lever 34 from the right and left side thereof, respectively, and then the lever is slid over shaft 60 until it abuts spacer bushing 62. Screw fastener 70 is then inserted through retaining washer 68 and fastener 70 is then screwed into internal threads 72 of shaft 60 until washer 68 is firmly abutted against lever 34. Right upper lever means 30 is mounted to the right side of shaft 60 in a similar manner and comprises spacer bushing 74, sintered bronze bushings 76 and 77 pressed into bore 78 of lever 36, washer 80 and fastener 82 which is screwed into internal threads (not shown) in the right end of shaft 60 similar to threads 72 of the left end of the shaft. It can be appreciated that the axis of shaft 60 forms an upper traverse axis 61 which is spaced substantially above lower traverse axis 182.

Figures 6, 7:
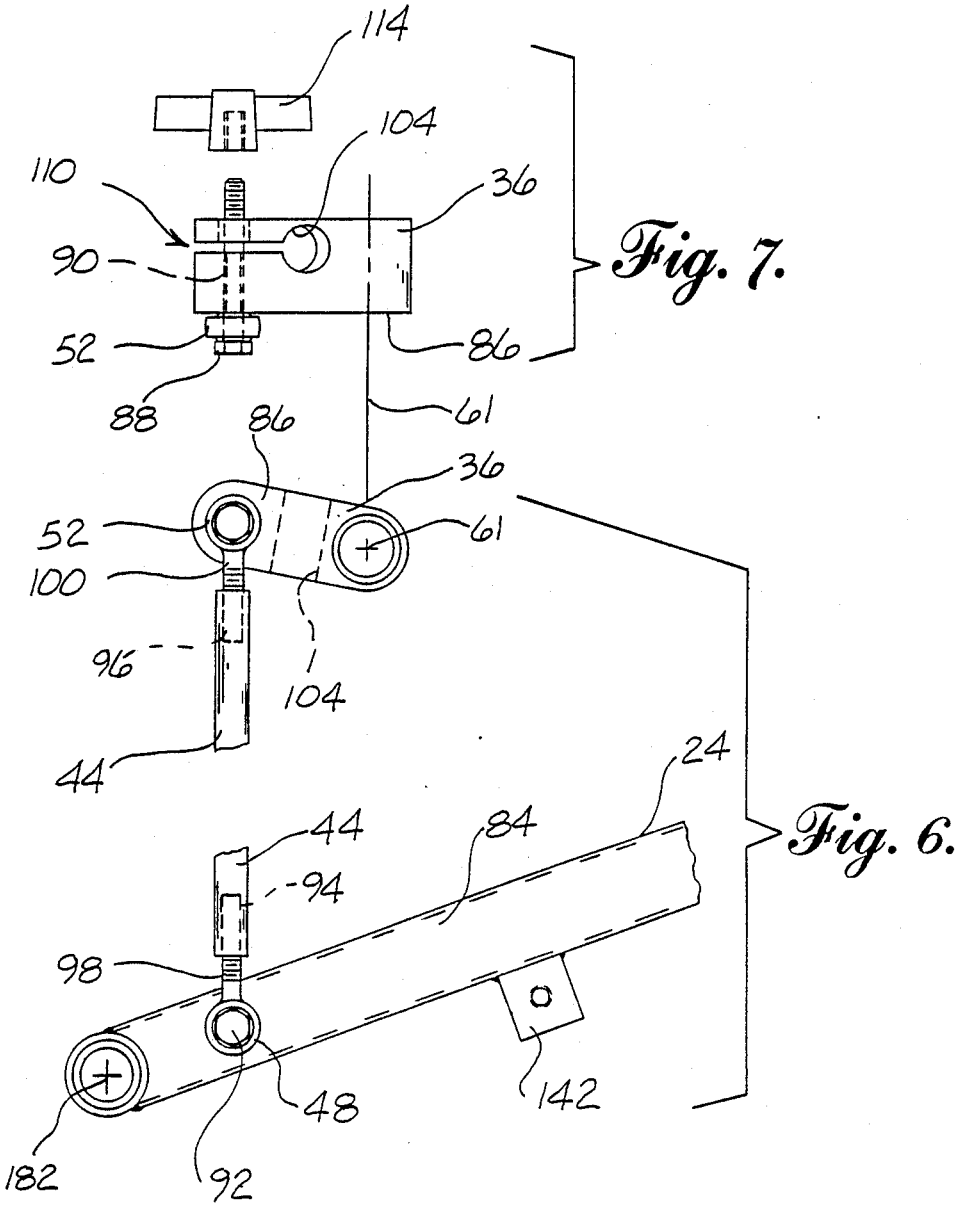
FIG. 6 is a left side elevational view of the right side tie rod assembly and pivotal connections to upper and lower levers of the machine of FIG. 1.
FIG. 7 is a top plan view of the upper lever and ball joint of FIG. 6 with the T-nut exploded away.

Referring now to FIGS. 6 and 7, right tie rod 44 is pivotally connected at its lower end to inside vertical surface 84 of lower lever 24 by ball joint 48 and pivotally connected at its upper end to inside vertical surface 86 of upper lever 36 by ball joint 52. Upper ball joint 52 is pivotally mounted to lever 36 by bolt 88 which is screwed into traverse bore 90 of lever 36. Lower ball joint 48 is pivotally mounted to lever 24 by fastener 92 which is screwed laterally into an internally thread bore (not shown) in vertical surface 84 of lever 24 in a manner similar to that shown in FIG. 8 with regard to fastener 148, ball joint 136 and internally threaded bore 150. Tie rod 44 contains internal threads 94 and 96 for receiving corresponding external threads 98 and 100 of ball joints 48 and 52, respectively. One of threads 98 and 100 is a right handed thread and the other is a left handed thread so that the distance between ball joints 48 and 52 can be adjusted to alter the position of the free ends of handlebars 38 and 40.

Left tie rod 42 is pivotally connected to levers 22 and 34 by ball joints 46 and 50, respectively, in a similar manner as rod 44 is pivotally connected to levers 24 and 36. Tie rod 44 also contains internal threads similar to threads 94 and 96 of rod 44 so that the distance between ball joints 46 and 50 can be adjusted to alter the position of the free ends of handlebars 38 and 40.

Upper levers 34 and 36 contain vertical bores 102 and 104, respectively, which are adapted to slidably receive handlebars 38 and 40, respectively. Handlebars 38 and 40 are inserted into bores 102 and 104, respectively, and adjusted to a height suitable for the user as shown by dotted lines 106 in FIG. 1 for both handlebars. Levers 34 and 36 contain longitudinal slots 108 and 110, respectively. After right handlebar 40 is adjusted to the desired height in upper lever 36, T-nuts 114 is tighten onto bolt 88 enough to slightly decrease the width of slot 110 thereby tightly holding handlebar 40 at the desired height in lever 36. In a similar manner left handlebar 38 is adjusted to the desired height in lever 34 by tightening T-nut 112 on a bolt (not shown) which passes through bore 116.

Figure 8:
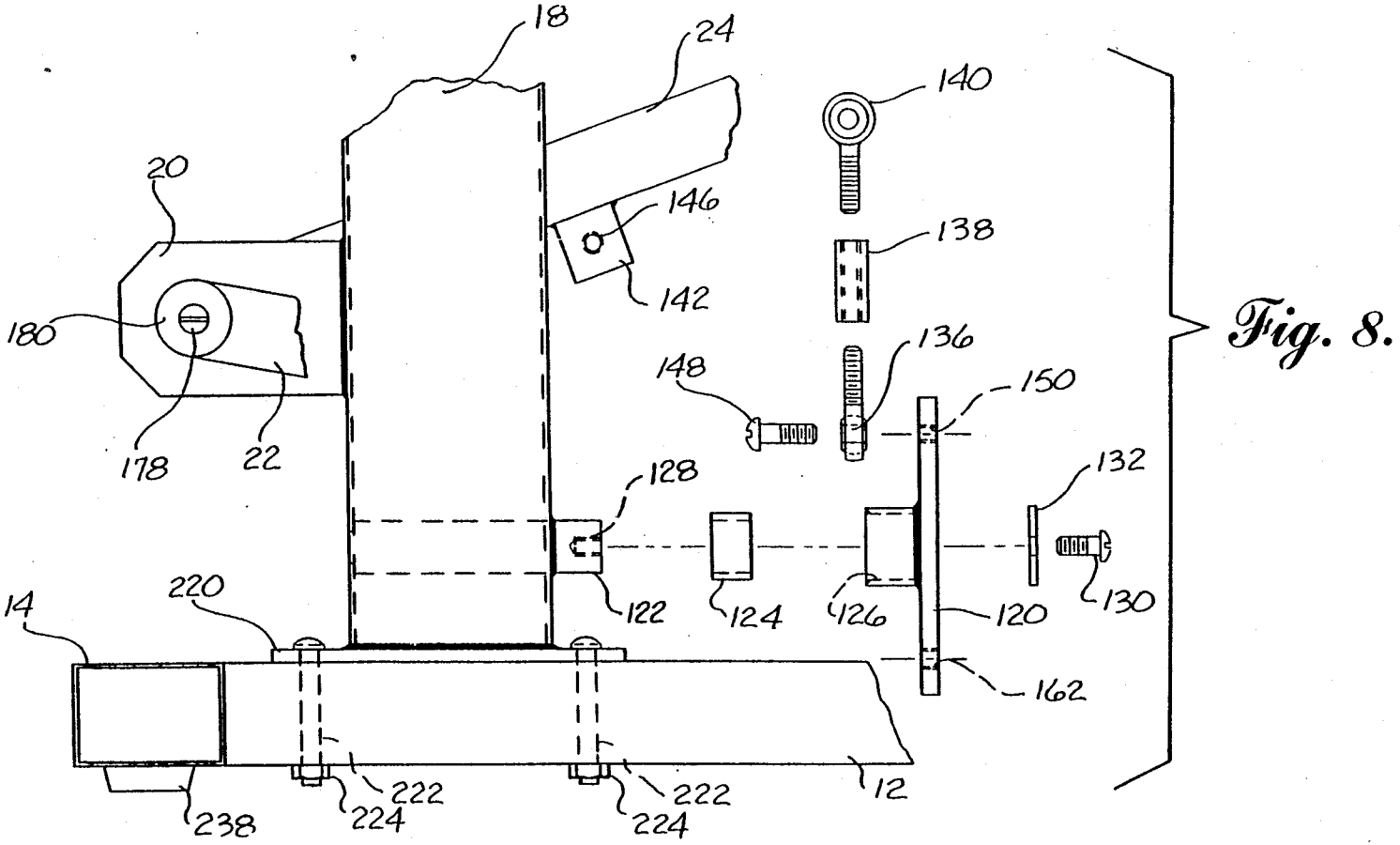
FIG. 8 is a left side elevational view partly broken away with the left-to-right synchronization means or rocker arm subassembly shown in exploded arrangement of the machine of FIG. 1.
Figures 9, 10:
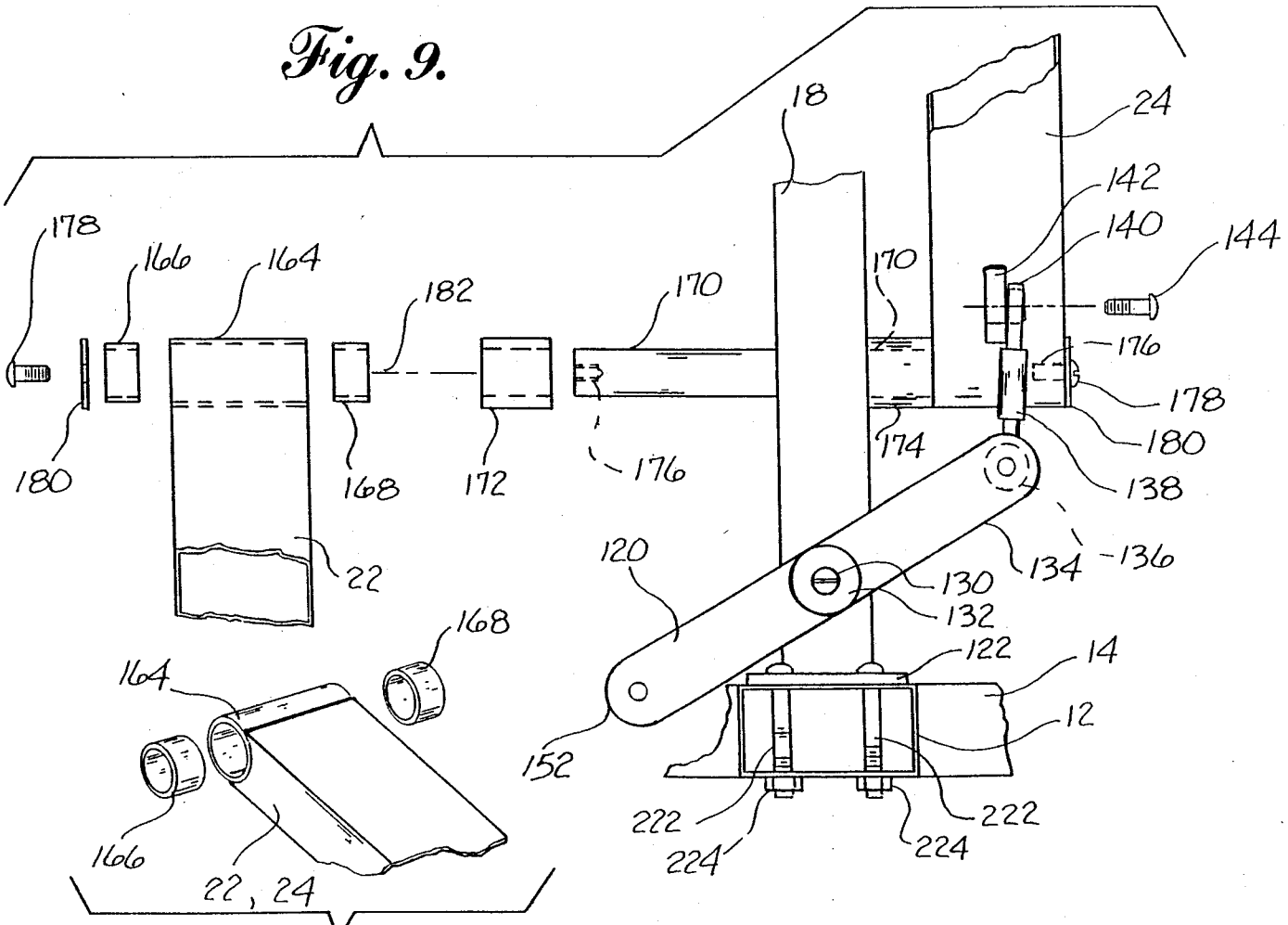
FIG. 9 is a front elevational view partly broken away of the rocker arm subassembly of FIG. 8 with the rear portion of the left lower lever shown in exploded arrangement.
FIG. 10 is a top, front and left perspective view broken away of the rear portion of the lower levers of the machine of FIG. 1, showing in explosive arrangement the bronze bushings thereof.

The details of synchronization means 54 are shown in FIGS. 8 and 9. Synchronization means 54 comprises rocker arm 120 which is pivotally mounted on frame member 18. Shaft 122 is welded to member 18. Shaft 122 is adapted to receive sintered bronze bushing 124 which in turn is adapted to be received by internal bore 126 of rocker arm 120. Shaft 122 contains internally threaded bore 128 adapted to receive externally threaded fastener 130. After bushing 124 is pressed into bore 126, rocker arm 120 is mounted on shaft 122 and fastener 130 with washer 132 is screwed into threaded bore 128.

Right end 134 of rocker arm 120 is pivotally connected to ball joint 136 which is connected to one end of short tie rod 138, the other end of which is connected to ball joint 140. Ball joint 140 is pivotally connected to bracket 142 by externally threaded fastener 144 which is screwed into internally threaded bore 146 of bracket 142. Ball joint 136 is pivotally mounted to end 134 of rocker arm 120 by fastener 148 which is screwed into internally threaded bore 150 of rocker arm 120.

Referring to FIGS. 3 and 9, left end 152 of rocker arm 120 is pivotally connected to ball joint 154 which is connected to one end of short tie rod 156, the other end of which is connected to ball joint 158. Ball joint 158 is pivotally connected to bracket 160 which is rigidly mounted on the underside of lower lever 22. Bracket 160 contains an internally threaded bore (not shown) similar to bore 146 of bracket 142. A fastener similar to fastener 144 is used to secure ball joint 158 to bracket 160. A fastener similar to fastener 148 is used to secure ball joint 154 to internally threaded bore 162 in the left side of rocker arm 120.

Short tie rods 138 and 156 contain internal threads for receiving corresponding external threads of right side ball joints 136 and 140, and left side ball joints 154 and 158, respectively. One end of tie rods 138 and 156 contain a right handed internal thread and the other end thereof a left handed internal thread so that the distances between ball joints 136 and 140 and ball joints 154 and 158 can be adjusted in a manner similar to that between ball joints 48 and 52 shown in FIG. 6.

The maximum step height between the free ends of lower levers 22 and 24 can be adjusted by turning tie rods 138 and 156, thereby providing means for adjusting the maximum step height. Since adjustment of the maximum step height will also effect the maximum hand spread, the machine should be adjusted for the maximum step height first before it is adjusted for the hand grip position.

FIGS. 8 to 10 also show how the lower levers 22 and 24 are pivotally mounted to frame member 20. FIG. 9 shows an explosive view of the mounting of lever 22 to member 20. As shown in FIG. 10, the pivotal ends of levers 22 and 24 contain annular sleeve 164 welded thereto. Pressed fitted into sleeve 164 are sintered bronze bearings 166 and 168. Cylindrical shaft 170 extends through member 20 and is welded thereto. Annular spacers 172 and 174 are slidably mounted on opposite sides of shaft 170 and abutted against member 20. The ends of shaft 170 contain internally threaded bores 176. Corresponding externally threaded fasteners 178 containing washers 180 are used to secure levers 22 and 24 to shaft 170. In particular, spacers 172 and 174 are first slid over shaft 170 from the left and right side, respectively. Then lower levers 22 and 24 each contain sleeve 164 which contains a pair of pressed fitted sintered bronze bearings 166 and 168, are slid over shaft 170 and abutted against spacers 172 and 174, respectively. Then fasteners 178 with washers 180 are screwed into bores 176 thereby securing the levers in a pivotal relationship to frame member 20. The axis of shaft 170 forms a lower traverse axis 182 which is spaced substantially below upper traverse axis 61.

Resistance means 56 comprises hydraulic cylinder 190, tubing 192 which contains flow control needle valve 194, piston rod 196, bracket 198, extension frame member 200, upper mount 202 and bearing or lower mount 204. Preferably hydraulic cylinder 190 contains an hydraulic fluid which experience very little viscosity change with temperature such as ATF type F fluid so that resistance to fluid flow through needle valve 194 remains constant throughout the workout period of the user. Hydraulic cylinder 190 can be mounted with piston rod 196 attached to bracket 198 as shown in the figures or inverted with piston rod 196 attached to upper mount 202.

Plate 212 is rigidly mounted to the top of frame member 18 and serves as a platform for mounting console 210. Console 210 preferably contains digital displays of user time, total steps, steps per minute and reset buttons therefor. In one embodiment, the console is microprocessor controlled with liquid crystal display 214 with touch sensitive membrane switch controls such as start/stop 215, mode 216 and reset 217 buttons. In another embodiment, console 210 also contains a jack for a pulse sensor and digital display of user present pulse rate.

Handlebars 38 and 40 preferably are fitted with hand grips 230 and 232, respectively, made from an elastic material such as vinyl or rubber. Similarly lower levers 22 and 24 preferably are fitted with high friction surfaces 234 and 236, respectively, made from an elastic material such as rubber and containing a ribbed upper surface to prevent the user's shoes from slipping off of the levers during use.

Attachment of frame members 14 and 16 to frame member 12 and attachment of frame member 20 to frame member 18 are preferably by welding. However, to facilitate shipping of the exercising machine in smaller containers, it is preferable to attach member 18 to member 12 by four bolts as shown in FIGS. 8 and 9. Preferably member or post 18 has rectangular plate 220 welded to the bottom thereof with four openings in the corners of plate 220 adapted to receive four bolts 222 which extend through plate 220 and the top and bottom of member 12 and secured by four nuts 224.

Preferably near each ends of the under-surface of frame members 14 and 16 there is attached non-skid elastic mounts 238 operable for preventing movement of the machine along its resting surface and damage thereto.

Preferably frame members 12 and 18 are made from 2-inch and 4-inch cold rolled electric welded ("CREW") rectangular steel tubing having a wall thickness of about 0.065 to about 0.083 inches; however, thinner wall thickness can be used if desired. Preferably frame members 14, 16 and 20 are made from 2 inch by 3 inch CREW rectangular steel tubing having a wall thickness of about 0.065 to about 0.083 inches; however, thinner thickness can be used if desired. Preferably lower levers 22 and 24 are made from 1.5 inch by 3 inch CREW rectangular steel tubing having a wall thickness of about 0.095 to about 0.120 inch; however, thinner wall thickness can be used if desired. Ball joints are preferably male rod spherical ball rod end. A non-limiting example of such ball joint pairs are Boston Gear catalog no. M-6CR and ML-6CR which have a $\frac{3}{8}$–24 UNF external thread. Tie rods 38, 40, 138 and 156 are preferably $\frac{5}{8}$ inch steel tubing with male internal threads at one end and female internal threads at the other end. Alternately hexagonal or square stock can be used if desired. Upper levers 34 and 36 are preferably made from aluminum. Handlebars 38 and 40 are preferably $\frac{7}{8}$ inch O.D., 0.065 inch wall thickness polished stainless steel tube. Plates 212 and 220 are preferably $\frac{1}{4}$ inch steel plate. Shafts 60, 128 and 170 are preferably 1.0 inch cold rolled steel, taped in free ends and welded in place as described above. Rocker arm 120 is preferably $\frac{3}{8}$ inch steel plate with welded bearing housing. Sintered bronze bushings 64, 65, 76, 77, 124, 166 and 168 are preferably 1.0 inch ID, 1.25 inch OD, such as Boston Gear B1620-6. Cylindrical sleeve 164 is preferably steel tubing drawn over mandrel for high precision inside diameter. Washers 68, 80, 132 and 180 and spacers 62, 74 and 172 are preferably made from a polymer acetyl resin plastic such as Delrin brand plastic. For appearance purposes, bolts 122 are preferably button head bolts.

Hydraulic cylinder 190 is preferably 1.5 inch bore, 6 inch stroke such as Bimba "500" hydraulic cylinder part no. H-176-DUZ. An example of flow control needle valve 194 is Rego part no. MN 250B.

In another embodiment, a small accumulator, 193 (shown in FIG. 3) is contained in line 192 to take up and release hydraulic fluid to compensate for unequal displacement of hydraulic fluid on opposite sides of the hydraulic cylinder piston caused by the presence of a piston rod on one side of the piston. Preferably the accumulator has an elastic diaphragm to isolate the gas side thereof from the hydraulic fluid side thereof so that gas does not become mixed with the hydraulic fluid. Preferable the accumulator is on the piston rod side of valve 194 so that all displaced hydraulic fluid is forced through valve 194.

Figure 11:
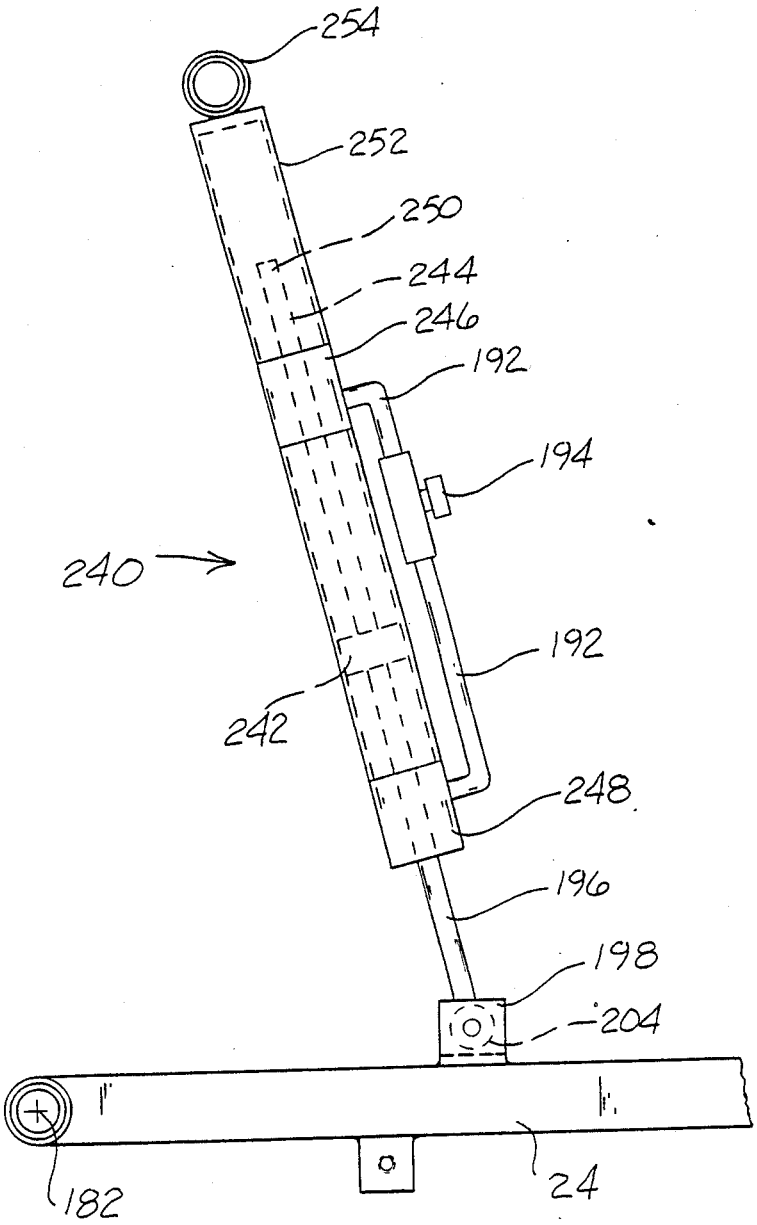
FIG. 11 is left side elevational view of another embodiment of the resistance means which utilizes a double rod end hydraulic cylinder.

In an especially preferred embodiment as shown in FIG. 11, hydraulic cylinder 190 is replaced with hydraulic cylinder 240 which has a piston rod which extends through both ends of the cylinder so that the volume displaced on one side of the piston equals the volume increase on the other side of the piston. In particular, cylinder 240 contains a conventional piston 242 and piston rod 196 but also an opposite piston rod 244 which passes through and is in slidable sealable relationship with cylinder head 246 in the same manner as piston rod 196 is in slidable sealable relationship with opposite cylinder head 248. Piston rod 248 has free end 250 which is at all times outside of head 246 regardless of the position of piston 242 between heads 246 and 248. Upper piston rod 244 is housed in cover member 252 which is rigidly attached to head 246 and eye mount 254. Eye mount 254 is pivotally attached to extension frame member 200 and lower eye mount 204 pivotally attached to bracket 198. By having exactly equal displacements on both sides of piston 242, equal resistance in compression and tension is achieved. In other words, the force required to move left lower lever 22 down, which places cylinder 240 in compression, is equal to the force required to move right lower lever 24 down, which places cylinder 240 in tension. Furthermore, no air or gas zone is required in double rod cylinder 240, nor alternatively an accumulator, to compensate for unequal displacements on opposite sides of the piston as is required in single rod cylinder 190. Use of an air or gas zone internally in cylinder 190 or alternatively use of an accumulator can cause a certain amount of sponginess in the resistance provided by the hydraulic cylinder when the cylinder is first placed in compression and tension at the start of a cycle or midcycle, that is whenever the direction of the lower levers is reversed. Furthermore, direct contact of the air or gas zone with the hydraulic fluid can in some circumstances result in emulsification of the hydraulic fluid particularly when the machine is operated at a high cycle frequency.

The housing of hydraulic cylinders 190 and 240 can be steel tubing or extruded aluminum with external fins to increase the surface area for heat dissipation and a hard anodized inside diameter for wear resistance and durability. The piston seal is preferably an U-cup seal. Heads 246 and 248 contain a rod bearing, a rod wiper and a rod seal at each rod port.

In the following alternative embodiments of my invention, as will now be described, common elements and components have the same element number in the various figures.

Figure 12:
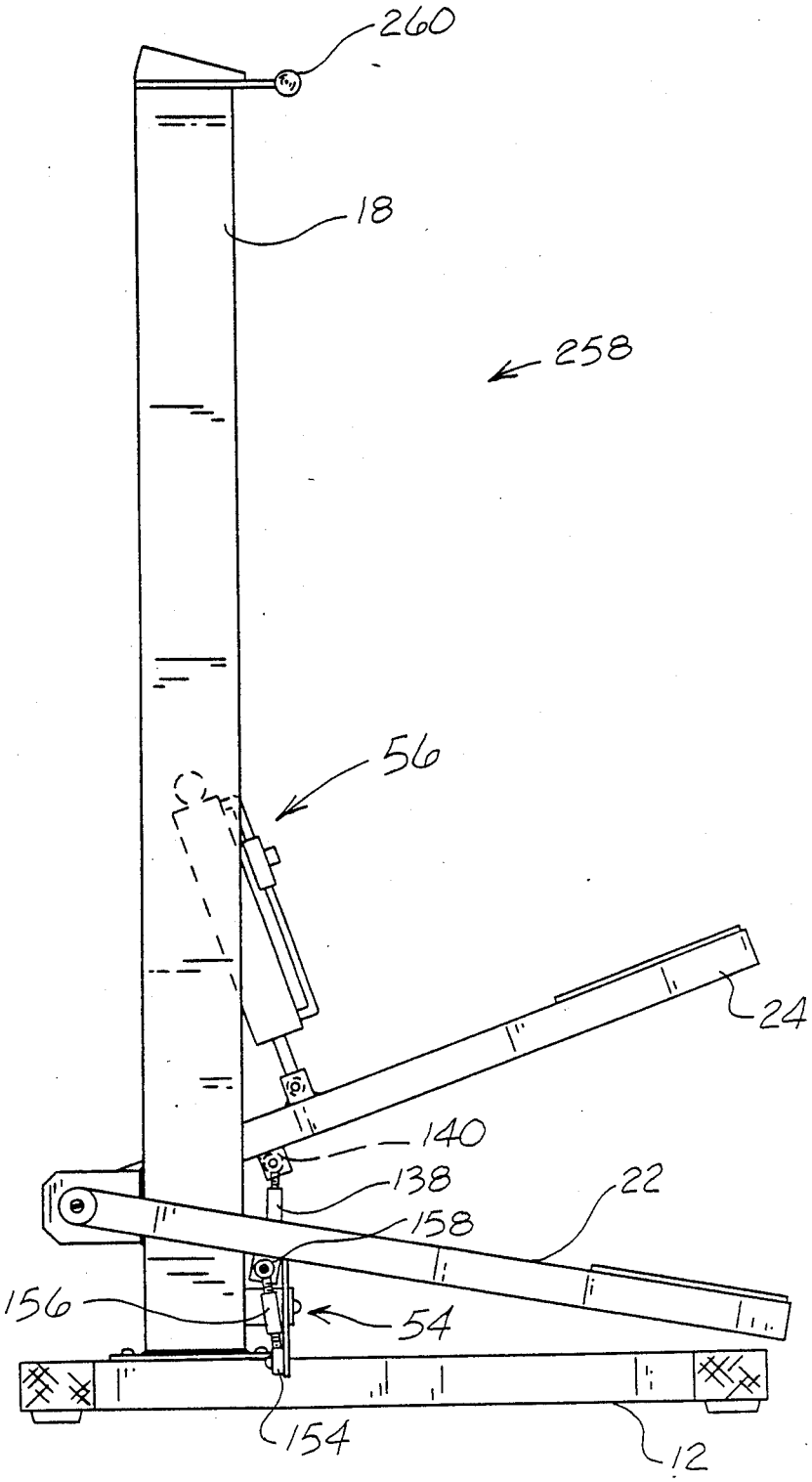
FIG. 12 is a left side elevational view of another embodiment of my invention similar to the embodiment of FIG. 1 but without upper levers.

In a less expensive and second embodiment of my invention, indicated by reference number 258 of FIG. 12, the upper levers and handlebar are replaced with handrail 260. Lower levers 22 and 24, synchronization means 54, and all other components of the exercising machine remain the same as shown in embodiment 10. In particular in embodiment 258 the synchronization means comprises rocker arm 120, short tie rods 138 and 156 and ball and socket joints 136, 140, 154 and 158 as described more fully with regard to FIG. 9. It can be appreciated that since rocker arm 120 moves principally in a vertical traverse plane while lower levers 22 and 24 move principally in a vertical longitudinal plane of the exercise machine, that resistance to the free movement of the various components of the synchronization means is eliminated or reduced to an insignificant amount by the use of ball joints. As a result, bumpy, jerky, or slack movement at the beginning of a cycle when the direction of motion of the mechanism is reversed, is for all actual user experience and awareness totally eliminated from the synchronization means thereby insuring a smooth continuous feel to the user, resisted only by the amount of resistance selected by the user through the resistance means and maximum step height settings.

Figures 13, 14:
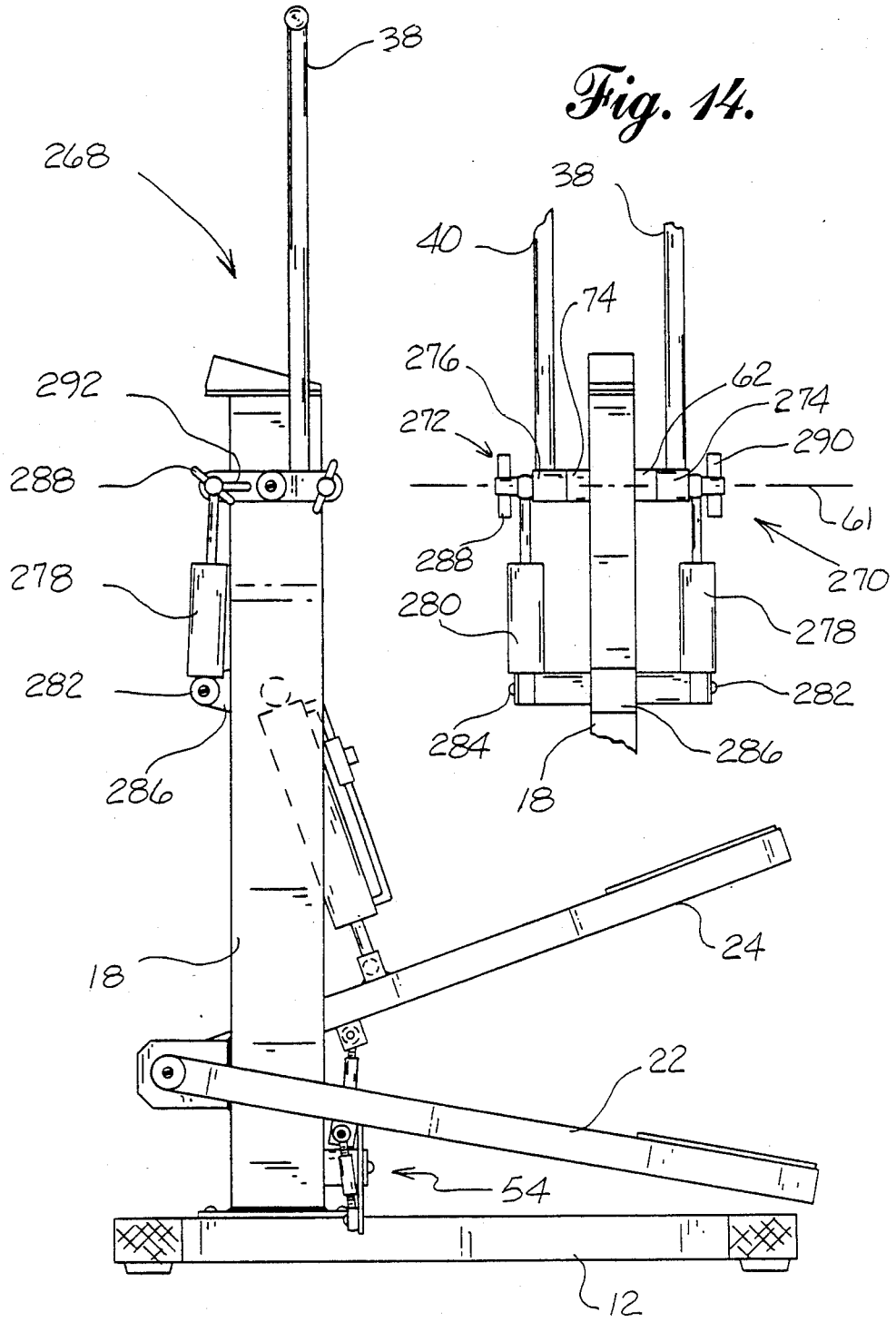
FIG. 13 is a left side elevational view of a third embodiment of my invention similar to the embodiment of FIG. 1 with independently operable upper levers.
FIG. 14 is a rear elevational view of the upper part of the embodiment shown in FIG. 13.

In a third embodiment of my invention, indicated by reference number 268 of FIG. 13, upper lever arm assemblies 270 and 272 are provided which can be operated independently of lower lever arms 22 and 24. The components of assemblies 270 and 272, shown also in FIG. 14, are similar to the components of embodiment 10 of FIG. 1 except that upper lever arms 34 and 36 (FIG. 5) have been modified. In FIGS. 13 and 14, upper levers 274 and 276 are longer and provide for pivotal connection of hydraulic cylinders 278 and 280 which provide resistance means to the movement of handlebars 38 and 40, respectively. Cylinders 278 and 280 are pivotally connected at lower ends 282 and 284 in a manner similar to that shown in FIGS. 8 and 9 for the lower levers. Extension member 286 supports the pivotal connection of the upper levers to upright frame member 18 in the same manner that extension member 20 supports pivotal connection of the lower levers to member 18. Cylinder 278 is pivotally connected by T-nut 288 to a bolt passing through slot 292 in lever 274 in a manner similar to that shown in FIG. 7 for T-nut 114. Cylinder 280 is pivotally connected by T-nut to a bolt passing through a similar slot in upper lever 276. These slots provide a means for adjusting the resistance to the movement of the handlebars.

Figure 15:
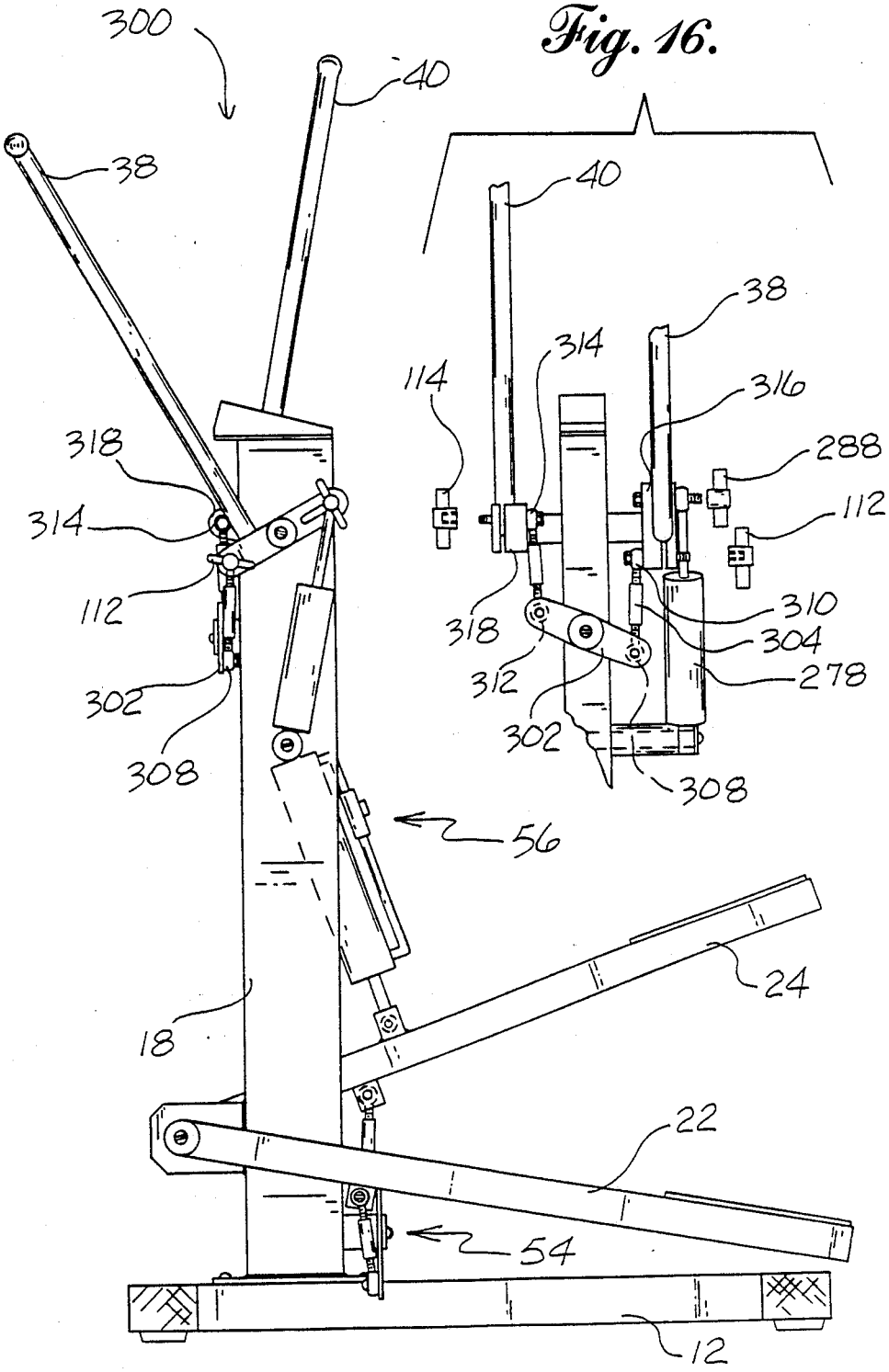
FIG. 15 is a left side elevational view of a fourth embodiment of my invention similar to the embodiment of FIG. 13 but with synchronized upper levers.

A fourth embodiment of my invention is indicated by reference number 300 of FIG. 15. In this embodiment, shown also in FIG. 16, rocker arm 302, tie rod 304 and 306, and ball and socket joints 308, 310, 312, and 314 provide means for synchronizing the movement of upper levers 316 and 318 relative to each other in a manner similar to that for synchronizing lower lever arms with lower rocker arm 120 shown in FIGS. 8 and 9. Ball joints 310 and 314 are pivotally connected to upper levers 316 and 318 is a manner similar to that of ball joints 50 and 52 of embodiment 10 shown in FIGS. 2, 6 and 7. Lower ball joints 308 and 312 are pivotally connected to the left and right ends, respectively, of rocker arm 302 in a manner similar to that of ball joints 136 and 154 of FIGS. 3, 8 and 9. Rocker arm 302 is pivotally attached to upright frame member 18 in a manner similar to the pivotal attachment of rocker arm 120 to member 18 shown in FIGS. 8 and 9.

In embodiment 300, hydraulic cylinder 278 is pivotally connected at its upper end to upper lever 316 and at its lower end to upright frame member 18. Cylinder 278 is pivotally connected by T-nut 288 to a bolt passing through slot 292 in lever 316 in a manner similar to that for T-nut 288 in embodiment 268 of FIG. 13. T-nuts 112, 114 and 288 are shown exploded away in FIG. 16. Preferably cylinder 278 is a double rod cylinder similar to that shown in FIG. 11 so that equal resistance is provided in both extension and compression. In this embodiment lower levers 22 and 24 are synchronized relative to each other, and upper levers 316 and 318 are synchronized relative to each other. Since the upper levers are synchronized to each other only one resistance means is necessary for the upper levers. Embodiments 268 and 300 are particularly useful where the user wants to increase the anaerobic exercise of his arms and upper body.

Figure 17:
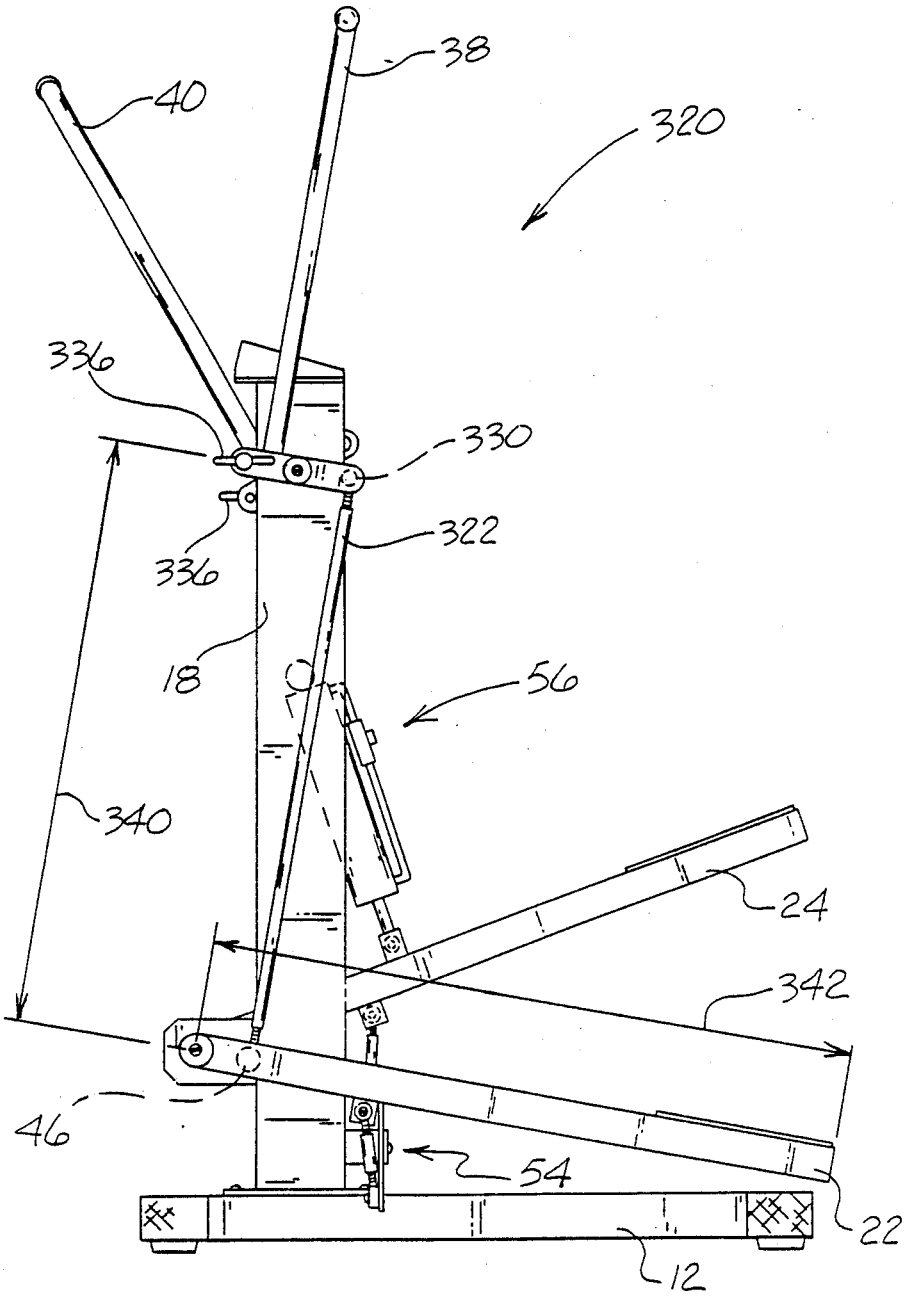
FIG. 17 is a left side elevational view of a fifth embodiment of my invention similar to the embodiment of FIG. 1 but with the upper lever arm motion reversed.
Figure 19:
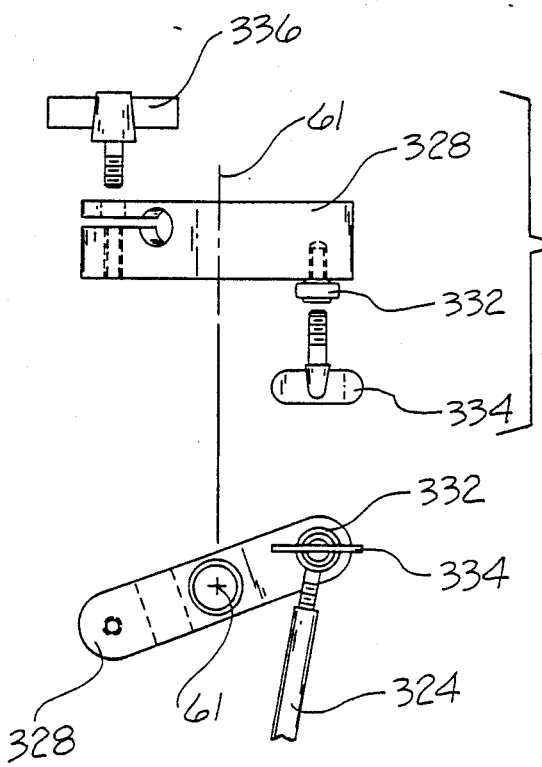
FIG. 19 is a top plan view of the upper lever and ball joint of FIG. 18 with the T-nut exploded away.
Figure 18:
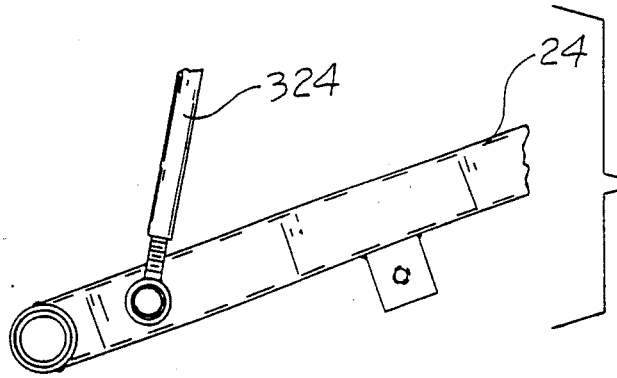
FIG. 18 is a left side elevational view of the right side tie rod assembly and pivotal connections to upper and lower levers of the embodiment shown in FIG. 17.
Figure 21:
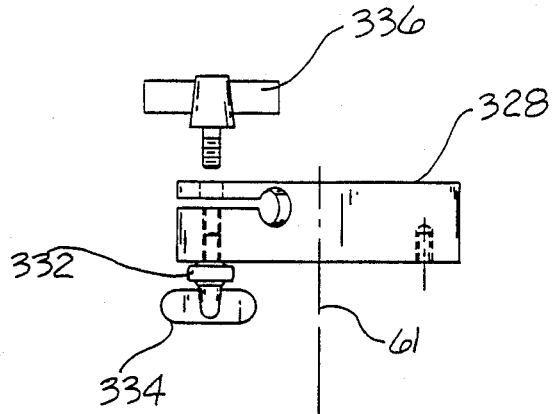
FIG. 21 is a top plan view of the upper lever and ball joint of FIG. 20 with the T-nut exploded away.
Figure 20:
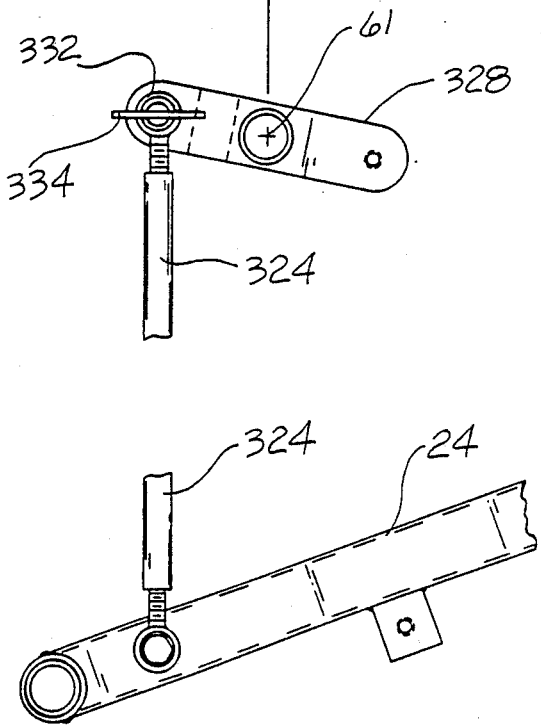
FIG. 20 is a left side elevational view of the right side tie rod assembly and pivotal connections to the upper and lower levers of the fifth embodiment of my invention but with the tie rod connected to the rearward end of the upper lever so that the motion of the upper levers relative to the lower levers is the same as in the embodiment of FIG. 1.

A fifth embodiment of my invention is indicated by reference number 320 of FIG. 17. In this embodiment, also shown in FIGS. 18 to 20, left and right side tie rods 322 and 324 are used, in a manner similar to tie rods 42 and 44, respectively, of embodiment 10, to synchronize the movement of upper levers 326 and 328, to lower levers 22 and 24, respectively. Tie rods 322 and 324 are pivotally connected by ball joints to lower levers 22 and 24, respectively, and upper levers 326 and 328, respectively, as shown in FIGS. 18 and 19 or alternatively as shown in FIGS. 20 and 21. Upper ball joints 330 and 332 are pivotally connected to upper levers 326 and 328, respectively, by wing bolts 334 as shown in FIGS. 18 and 19. Wing bolts 334 and 336 are shown exploded away in FIG. 19. Left upper lever 326 is the mirror image of right upper lever 328 seen best in FIG. 19. Handlebars 38 and 40 are secured to upper levers 326 and 328, respectively, by wing bolts 336 shown exploded away in FIG. 21.

In FIGS. 17 to 19 tie rods 322 and 324 are connected to the front part of upper levers 330 and 332, respectively. In this particular configuration it will be noted that when the free end of a lower lever is at its lowest elevation the handlebar grip on the same side is at its closest forward position and when the free end of a lower lever is at its highest elevation the handlebar grip on the same side is at its farthest rearward position. In this configuration the handlebar and the lower lever on the same side of the exercising machine rotate in the same direction. To reverse the direction of handlebar movement, tie rods 322 and 324 are connected to the rearward end of levers 326 and 328, respectively, as shown in FIGS. 20 and 21, whereupon as in embodiment 10, the handlebar and lower lever arm on the same side of the machine will rotate in opposite directions. Accordingly, it will be appreciated that embodiment 320 permits the rotation of a handlebar to be in the same direction or the opposite direction of the rotation of the lower lever on the same side of the exercise machine by simply fastening upper ball joints 330 and 332 and tie rods 322 and 324 to their farthest forward position, or alternatively their farthest rearward position, on upper levers 326 and 328.

The ratio of the pivot-to-pivot separation, shown by line 340 in FIG. 17, to the lower-lever-longitudinal length, shown by line 342 in embodiment 320 of this invention is about 0.9. In embodiments 10 (FIG. 1), 268 (FIG. 13) and 300 (FIG. 15) this ratio is also about 0.9. This ratio allows for a maximum hand spread (distance 41, FIG. 3) in which one of the user's arms is straight while the other one of the user's arms is bent at the elbow at least 90 degrees (angle 59, FIG. 4), and also minimizes the mechanical advantage provided by the upper lever arm assemblies and handlebars, i.e. minimizing the length of handlebars 38 and 40. Minimizing the distance between the hand grips and upper pivot axis 61 allows the resistance means or hydraulic cylinder to have a lower resistance value which in turn decreases the weight of the resistance means and reduces the bending moment to the handlebars. Ratios below 0.5 require higher force value resistance means and stronger handlebars to prevent bending of handlebars, which in turn will add to the weight of the exercise machine. When the pivot axis of the upper lever arm assemblies is close to, or below the pivot point of the lower lever arms, the upper handlebars are relatively very long and result in a mechanical advantage which is so great that twisting of the pivots of the upper lever arms will occur unless the user is careful not to apply any traverse force to the hand grips. In other words the user must be careful to apply only longitudinal force to the hand grips to avoid damage to the pivot point of the upper lever arms. Therefore, in one embodiment of my invention, upper pivot point axis 61 is substantially above lower pivot point axis 182.

In all of the preferred embodiments shown in FIGS. 1 to 21, jerky, bumpy and slack operation of the lower levers and handlebars are prevented by using ball joints and tie rods as the means for preventing play. Therefore, slack conditions, especially at the initiation of motion at the start of a new cycle, and half cycle, are eliminated or reduced to the point where the user is not conscious of such play. Furthermore, wire cables and ropes which tend to fray and break and chains and sprockets and slots and cam followers which inherently have significant play are not required. Therefore, one embodiment of this invention is an exercise machine which is free of pulleys, ropes, wire cables, and chains and sprockets, and cams or slots and cam followers.

In all of the embodiments the resistance means can be an hydraulic cylinder preferably the hydraulic cylinder is double piston of the type shown in FIG. 11 which provides for equal displacement of fluid in the cylinder for both extension and compression.

By using ball joints for all tie rods, sintered bronze bushings, and an hydraulic cylinder for the resistance means, the preferred embodiment of the exercising machine of this invention is whisper quiet when in use and as such can be enjoyed in an user's apartment without disturbing residents in adjacent apartments. Because the whisper quiet nature of the exercising machine the user can listen to television or stereo simultaneously while exercising without having to turn the sound up to compensate for noise produced by the machine. Whereas exercising machines using chains, gears or weights are relatively noisy when used and relatively messy because of the lubricating grease, the exercising machine of this invention can be safely used and housed in the user's living quarters rather than the garage, basement or gymnasium.

While the preferred embodiments of the present invention have been described it should be understood that various changes, adaptations and modifications may be made thereto without departing from the spirit of the invention and the scope of the appended claims. It should be understood, therefore, that the invention is not to be limited to minor details of the illustrated invention shown in the figures and that variations in such minor details will be apparent to one skilled in the art.

Therefore it is to be understood that the present disclosure and embodiment of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. An exercising machine for synchronized exercise of an user's legs while remaining in an upright standing position, the exercise machine comprising:

(a) a base structure operable for maintaining the exercise machine in an upstanding position;

(b) an upright frame member extending upwardly from the base structure;

(c) right and left lower lever arms having first ends pivotally mounted on a lower portion of the upright frame member about a first, lower pivot axis, the opposite, free ends of right and left lower lever arms being operable for standing on by the user's right and left feet, respectively;

(d) synchronizing means for synchronizing the movement of the lower lever arms, the synchronizing means comprising a rocker arm and right and left connection means, the rocker arm having right and left ends and being pivotally mounted at its center to the upright frame member thereby enabling the rocker arm to rotate in a traverse plane which is approximately vertical, the right connection means having one end pivotally connected to the right lower lever arm and an opposite end pivotally connected to the right end of the rocker arm, the left connection means having one end pivotally connected to the left lower lever arm and an opposite end pivotally connected to the left end of the rocker arm, the synchronizing means being operable when one of the lower lever arms is moving downwardly to cause the other one of the lower lever arms to move upwardly, and when the free end of one of the lower lever arms is at its lowest elevation, the free end of the other one of the lower lever arms is at its highest elevation; and (e) resistance means for resisting the movement of at least one of the lower lever arms.

2. The exercise machine according to claim 1, wherein the synchronizing means includes means for preventing play in the lower lever arms when the direction of the lower lever arms is reversed.

3. The exercise machine according to claim 1, wherein the right and left connection means are pivotally connected to the rocker arm and the lower lever arms by ball joints.

4. The exercise machine according to claim 1, wherein when the free end of one of the lower lever arms is at its lowest elevation the distance between the free ends of the lower lever arms define a maximum step height, and further comprising means for adjusting the maximum step height.

5. The exercise machine according to claim 1, wherein when the free end of one of the lower lever arms is at its lowest elevation the distance between the free ends of the lower lever arms define a maximum step height, and wherein the connection means includes means for adjusting the maximum step height.

6. The exercise machine according to claim 1, further comprising a hand grip fastened to the upright frame member.

7. The exercise machine according to claim 1, further comprising right and left upper arms each having a hand grip, the upper arms being fastened to the upright frame member.

8. The exercise machine according to claim 1, further comprising right and left upper arms each having a hand grip, the upper arms being pivotally connected to the upright frame member.

9. The exercise machine according to claim 8, wherein the right and left upper arms include means for synchronizing the movement of the right upper arm to the left upper arm.

10. The exercise machine according to claim 8, further comprising resistance means for resisting the movement of the upper arms.

11. The exercise machine according to claim 8, further comprising adjustable resistance means for providing adjustable resistance to the movement of the upper arms.

12. An exercise machine for synchronized exercising of an user's legs and arms while remaining in an upright standing positions, the exercise machine comprising:

(a) a base structure operable for maintaining the exercise machine in an upright standing position;

(b) an upright frame member extending upwardly from the base structure;

(c) right and left lower arms having first ends pivotally mounted on a lower portion of the upright frame member about a first, lower pivot axis, the opposite, free ends of the right and left lower lever arms being operable for standing on by the user's right and left feet, respectively;

(d) means for synchronizing the movement of the lower lever arms, said synchronizing means being operable when one of the lower lever arms is moving downwardly to cause the other one of the lower lever arms to move upwardly, and when the free end of one of the lower lever arms is at its lowest elevation, the free end of the other of the lower lever arms is at its highest elevation;

(e) right and left upper lever assemblies each having:

(i) an upper lever arm pivotally mounted on the upright frame member about a second, upper pivot axis located at an elevation above the elevation of the lower pivot axis; and, (ii) a hand grip connected to the upper lever arm and intended for hand grasping, the upper lever assemblies being operable for rotating the hand grips in a principally forward to rearward to forward motion; and (f) resistance means for resisting the movement of at least one of the lever arms.

13. The exercise machine according to claim 12, wherein the right and left upper arms include means for synchronizing the movement of the right upper arm to the left upper arm.

14. The exercise machine according to claim 12, further comprising resistance means for resisting the movement of the upper arms.

15. The exercise machine according to claim 12, further comprising adjustable resistance means for providing adjustable resistance to the movement of the upper arms.

16. An exercise machine for synchronized exercising of an user's legs and arms while remaining in an upright standing position, the exercise machine comprising:

(a) a base structure operable for maintaining the exercise machine in an upright standing position;

(b) an upright frame member extending upwardly from the base structure;

(c) right and left lower lever arms having first ends pivotally mounted on a lower portion of the upright frame member about a first, lower pivot axis, the opposite, free ends of the right and left lower lever arms being operable for standing on by the user's right and left feet, respectively;

(d) means for synchronizing the movement of the lower lever arms, said synchronizing means being operable when one of the lower lever arms is moving downwardly to cause the other one of the lower lever arms to move upwardly, and when the free end of one of the lower lever arms is at its lowest elevation, the free end of the other of the lower lever arms is at its highest elevation;

(e) right and left upper lever assemblies each having:

(i) an upper lever arm pivotally mounted on the upright frame member about a second, upper pivot axis located at an elevation above the elevation of the lower pivot axis; and, (ii) a hand grip connected to the upper lever arm and intended for hand grasping, the upper lever assemblies being operable for rotating the hand grips in a principally forward to rearward to forward motion;

(f) means for synchronizing the movement of one of the upper lever arms to one of the lower lever arms;

(g) means for synchronizing the movement of the other one of the upper lever arms to the other one of the lower lever arms; and (h) resistance means for resisting the movement of at least one of the lever arms.

17. The exercise machine according to claim 16, wherein the synchronizing means comprises a rocker arm and right and left connection means, the rocker arm having right and left ends, the rocker arm being pivotally mounted at its center to the upright frame member thereby enabling it to rotate in a traverse plane which is approximately vertical, the right connection means having one end pivotally connected to the right lower lever and an opposite end pivotally connected to the right end of the rocker arm, and the left connection means having one end pivotally connected to the left lower lever and an opposite end pivotally connected to the left end of the rocker arm.

18. The exercise machine according to claim 16, wherein the synchronizing means includes means for preventing play in the lower lever arms when the direction of the lower lever arms is reversed.

19. The exercise machine according to claim 16, wherein the right and left connection means are pivotally connected to the rocker arm and the lower levers by ball joints.

20. The exercise machine according to claim 16, wherein when the free end of one of the lower lever arms is at its lowest elevation the distance between the free ends of the lower lever arms define a maximum step height, and further comprising means for adjusting the maximum step height.

21. The exercise machine according to claim 16, wherein when the free end of one of the lower lever arms is at its lowest elevation the distance between the free ends of the lower lever arms define a maximum step height, and wherein the connection means includes means for adjusting the maximum step height.

22. The exercise machine according to claim 16, further comprising means for preventing play in the upper lever arms when the direction of the upper lever arms is reversed.

23. The exercise machine according to claim 16, wherein the means for synchronizing the movement of the upper lever arms to the lower lever arms includes means for preventing play in the upper lever arms when the direction of the upper lever arms is reversed.

24. The exercise machine according to claim 23, wherein said means for preventing play comprises tie rods having ball and socket pivotal connection to the upper and lower lever arms.

25. An exercise machine for simulating climbing motion by a user's legs and synchronized push-pull motion by the user's arms while remaining in an upright standing position, the exercise machine comprising;

(a) a base structure operable for maintaining the exercise machine in an upright standing position;

(b) an upright frame member extending upwardly from the base structure;

(c) right and left lower lever arms having first ends pivotally mounted on a lower portion of the upright frame member about a first, lower pivot axis, the opposite, free ends of the right and left lower lever arms being operable for standing on by the user's right and left feet, respectively;

(d) means for synchronizing the movement of the lower lever arms, said synchronizing means being operable when one of the lower lever arms is moving downwardly to cause the other one of the lower lever arms to move upwardly, and when the free end of one of the lower lever arms is at its lowest elevation, the free end of the other of the lower lever arms is at its highest elevation;

(e) right and left upper lever assemblies having;

(i) upper lever arms pivotally mounted on the upright frame member about a second, upper pivot axis located at an elevation above the elevation of th lower pivot axis; and, (ii) handlebars extended generally upwardly from respective upper lever arms and having manually grasping free end portions;

(f) linkage means interconnecting the right and left lower lever arms with corresponding right and left upper lever assemblies, whereby rotation of a lower lever arm on first side of the exercise machine in one direction about the lower pivot axis causes rotation of the upper lever arm on one side of the machine in an opposite direction about the upper pivot axis, and whereby, when the free end of either of the lower lever arms is in its lowest elevation, the free end of the handlebar on one side of the exercise machine is in its farthest position away from the lower lever arm free end and whereby, when the free end of either of the lower lever arms is at its highest elevation, the free end of the handlebar on one side of the machine is in its nearest position toward the lower lever arm free end; and, (g) resistance means for resisting the movement of at least one of the lever arms.

26. The exercise machine according to claim 25, wherein the upright frame member includes a post having its lower end fixedly attached to the base structure.

27. The exercising machine according to claim 25, wherein the linkage means and the synchronizing means includes means operable for effecting a maximum step height large enough to cause one of the user's legs to be bent at the knee at least about a right angle when the other one of the user's legs in straight, and operable for effecting a maximum hand spread large enough to cause one of the user's arms to be bent at the elbow at least about a right angle when the other one of the user's arms is straight.

28. The exercise machine according to claim 25, wherein the linkage means comprise:

(a) right and left tie rods;

(b) first means for pivotally connecting the upper ends of the tie rods to the right and left upper lever assemblies, respectively; and, (c) second means for pivotally connecting the lower ends of the right and left tie rods to the right and left lower lever arms, respectively.

29. The exercise machine according to claim 25, wherein the synchronizing means comprises a rocker arm and right and left connection means, the rocker arm having right and left ends, the rocker arm being pivotally mounted at its center to the upright frame member thereby enabling it to rotate in a traverse plane which is approximately vertical, the right connection means having one end pivotally connected to the right lower lever and an opposite end pivotally connected to the right end of the rocker arm, and the left connection means having one end pivotally connected to the left lower lever and an opposite end pivotally connected to the left end of the rocker arm.

30. The exercise machine according to claim 25, wherein the synchronizing means includes means for preventing play in the lower lever arms when the direction of the lower lever arms is reversed.

31. The exercise machine according to claim 25, further comprising means for preventing play in the upper lever arms when the direction of the upper lever arms is reversed.

32. The exercise machine according to claim 25, wherein the means for synchronizing the movement of the upper lever arms to the lower lever arms includes means for preventing play in the upper lever arms when the direction of the upper lever arms is reversed.

33. The exercise machine according to claim 32, wherein said means for preventing play comprises tie rods having ball and socket pivotal connection to the upper and lower lever arms.

34. An exercise machine for simulating climbing motion by a user's legs and synchronized push-pull motion by the user's arms while remaining in an upright standing position, the exercise machine comprising:

(a) a base structure operable for maintaining the exercise machine in an upright standing position;

(b) an upright frame member extending upwardly from the base structure;

(c) right and left lower lever arms having first ends pivotally mounted on a lower portion of the upright frame member about a first, lower pivot axis, the opposite, free ends of the right and left lower lever arms being operable for standing on by the user's right and left feet, respectively;

(d) means for synchronizing the movement of the lower lever arms, said synchronizing means being operable when one of the lower lever arms is moving downwardly to cause the other one of the lower lever arms to move upwardly, and when the free end of one of the lower lever arms is at its lowest elevation, the free end of the other of the lower lever arms is at its highest elevation;

(e) right and left upper lever assemblies having:

(i) upper lever arms pivotally mounted on the upright frame member about an upper pivot axis located at an elevation substantially above the elevation of the lower pivot axis; and, (ii) handlebars extended generally upwardly from respective upper lever arms and having manually graspable free end portions;

(f) linkage means interconnecting the right and left lower lever arms with corresponding right and left upper lever assemblies, whereby rotation of a lower lever arm on either side of the exercise machine in one direction about the lower pivot axis causes rotation of the upper lever arm on the same side of the machine in an opposite direction about the upper pivot axis, and whereby, when the free end of either of the lower lever arms is in its lowest elevation, the free end of the handlebar on the same side of the exercise machine is in its farthest position away from the lower lever arm free end and whereby, when the free end of either of the lower lever arms is at its highest elevation, the free end of the handlebar on the same side of the machine is in its nearest position toward the lower lever arm free end; and, (g) resistance means for resisting the movement of the lower lever arms and the upper lever assemblies.

35. The exercise machine according to claim 34, wherein the upright frame member includes a post having it lower end fixedly attached to the base structure.

36. The exercising machine according to claim 34, wherein the linkage means and the synchronizing means includes means operable for effecting a maximum step height large enough to cause one of the user's legs to be bent at the knee at least about a right angle when the other one of the user's legs is straight, and operable for effecting a maximum hand spread large enough to cause one of the user's arms to be bent at the elbow at least about a right angle when the other one of the user's arms is straight.

37. The exercise machine according to claim 34, wherein the linkage means comprise:

(a) right and left tie rods;

(b) first means for pivotally connecting the upper ends of the tie rods to the right and left upper lever assemblies, respectively; and, (c) second means for pivotally connecting the lower ends of the right and left tie rods to the right and left lower lever arms, respectively.

38. The exercise machine according to claim 34, wherein the resistance means is interconnected to at least one of the lower lever arms or upper lever assemblies.

39. An exercising machine for synchronized exercise of an user's legs while remaining in an upright standing position, the exercise machine comprising:

(a) a support structure having a base structure operable for maintaining the exercise machine in an upstanding position, and an upright frame member connected to and extending upwardly from the base structure;

(b) right and left lower lever arms having first ends pivotally mounted on a lower portion of the upright frame member about a first, lower pivot axis, the opposite, free ends of right and left lower lever arms being operable for standing on by the user's right and left feet, respectively;

(c) synchronizing means for synchronizing the movement of the right and left lower lever arms, the synchronizing means comprising a rocker arm and right and left connection means, the rocker arm having right and left ends and being pivotally mounted at its center to the support structure thereby enabling the rocker arm to rotate in a traverse plane which is approximately vertical , the right connection means having one end pivotally connected to the right lower lever arm and an opposite end pivotally connected to the right end of the rocker arm, the left connection means having one end pivotally connected to the left lower lever arm and an opposite end pivotally connected to the left end of the rocker arm, the synchronizing means being operable when one of the lower lever arms is moving downwardly to cause the other one of the lower lever arms to move upwardly, and when the free end of one of the lower lever arms is at its lowest elevation, the free end of the other one of the lower lever arms is at its highest elevation; and (d) resistance means for resisting the movement of at least one of the lower lever arms.

40. The exercising machine according to claim 39, wherein the synchronizing means includes means for preventing play in the lower lever arms when the direction of the lower lever arms is reversed.

41. The exercising machine according to claim 39, wherein the right and left connection means are pivotally connected to the rocker arm and the lower lever arms by ball joints.

42. The exercising machine according to claim 39, wherein when the free end of one of the lower lever arms is at lowest elevation the distance between the free ends of the lower lever arms defines a maximum step height, and further comprising means for adjusting the maximum step height.

43. The exercising machine according to claim 39, wherein when the free end of one of the lower lever arms is at lowest elevation the distance between the free ends of the lower lever arms defines a maximum step height, and wherein the connection means includes means for adjusting the maximum step height.

44. The exercising machine according to claim 39, further comprising a hand grip fastened to the upright frame member.

45. The exercising machine according to claim 39, further comprising right and left upper arms each having a hand grip, the upper arms being fastened to the upright frame member.

46. The exercising machine according to claim 39, further comprising right and left upper arms each having a hand grip, the upper arms being pivotally connected to the upright frame member.

47. The exercising machine according to claim 46, wherein the upper arms include means for synchronizing the movement of the right upper arm to the left upper arm.

48. The exercising machine according to claim 46, further comprising resistance means for resisting the movement of the upper arms.

49. The exercising machine according to claim 46, further comprising adjustable resistance means for providing adjustable resistance to the movement of the upper arms.

* * * * *

US004934690B1

REEXAMINATION CERTIFICATE (2522nd)

United States Patent [19]

Bull

[11] B1 4,934,690

[45] Certificate Issued Apr. 4, 1995

[54] SHOCK-FREE AEROBIC AND ANAEROBIC EXERCISING MACHINE FOR USE IN THE STANDING POSITION

[76] Inventor: John W. Bull, 2502 Wedgewood Ct., Olympia, Wash. 98501

Reexamination Request:
No. 90/003,328, Feb. 2, 1994

Reexamination Certificate for:

| | |
|---|---|
| Patent No.: | **4,934,690** |
| Issued: | **Jun. 19, 1990** |
| Appl. No.: | **351,846** |
| Filed: | **May 12, 1989** |

Related U.S. Application Data

[63] Continuation-in-part of Ser. No. 181,302, Apr. 13, 1988, Pat. No. 4,830,362.

[51] Int. Cl.[6] ..... A63B 23/04
[52] U.S. Cl. ..... 482/52; 482/112
[58] Field of Search ..... 482/51, 52, 53, 111, 482/112, 113, 62, 148

[56] References Cited

U.S. PATENT DOCUMENTS 3,128,094 4/1964 Wolf ..... 482/112
4,159,111 6/1979 Lowth .
4,563,001 1/1986 Terauds ..... 482/53

*Primary Examiner*—S. R. Crow

[57] ABSTRACT

A shock-free exercising machine, which can be used by the young and elderly, the small and large structured person, and the inexperienced and experienced exerciser for both aerobic and anaerobic exercise, that provides a rhythmic fluid motion to the body of the user and particularly to the legs, pelvis and spine which is completely free of shock and impact stress on the joints, bones and muscles in which, at all times, the user remains in an upright standing position. In one embodiment the exercise simulates climbing motion of the user's legs with synchronized push-pull motion of the user's arms. On one embodiment the exercising machine comprises a base member; a vertical frame member fixedly attached there, right and left lower levers pivotally mounted on the lower part of the vertical member, the free ends the levers for standing on; right and left upper levers pivotally mounted on the upper part of the vertical member; right and left tie rods pivotally mounted at the upper distal ends thereof to the right and left upper levers, respectively; and pivotally mounted at the lower distal ends thereof to the right and left lower levers, respectively; rocker arm assembly for synchronizing the movement of the lower levers so that when one lower lever moves downwardly the other one moves upwardly; and shock-free resistance system for resisting the movement of at least one of the levers.

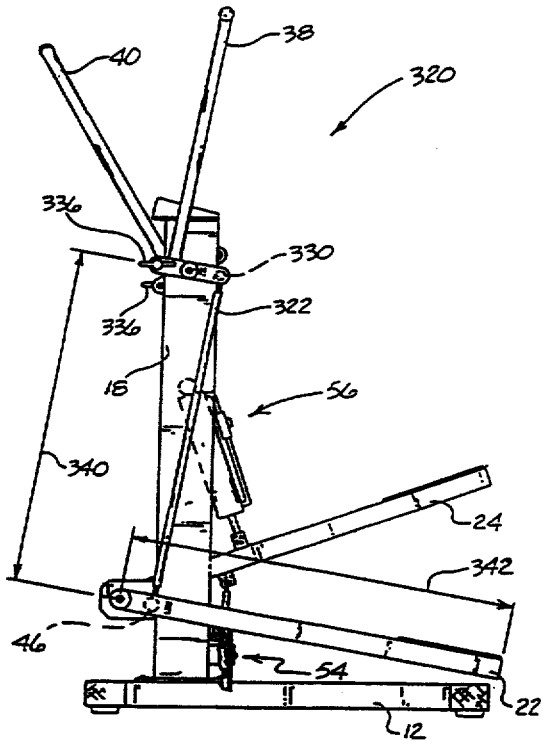

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–49 has been confirmed.

* * * * *